US012728366B2

(12) United States Patent
Rosenbaum et al.

(10) Patent No.: US 12,728,366 B2
(45) Date of Patent: Sep. 8, 2026

(54) TRANSFORMABLE GAME TOY

(71) Applicant: Stylus Worldwide, LLC, Boca Raton, FL (US)

(72) Inventors: Barry Rosenbaum, Boca Raton, FL (US); Olivier Andre, Hong Kong (CN)

(73) Assignee: STYLUS WORLDWIDE LLC, Boca Raton, FL (US)

( * ) Notice: Subject to any disclaimer, the term of this patent is extended or adjusted under 35 U.S.C. 154(b) by 183 days.

(21) Appl. No.: 18/821,383

(22) Filed: Aug. 30, 2024

(65) Prior Publication Data

US 2025/0073609 A1 Mar. 6, 2025

Related U.S. Application Data

(60) Provisional application No. 63/579,732, filed on Aug. 30, 2023.

(51) Int. Cl.
*A63H 33/04* (2006.01)

(52) U.S. Cl.
CPC ..... *A63H 33/042* (2013.01); *A63H 33/046* (2013.01)

(58) Field of Classification Search
CPC ..... A63H 33/04; A63H 33/042; A63H 33/046
USPC ..... 446/102, 478, 487
See application file for complete search history.

(56) References Cited

U.S. PATENT DOCUMENTS 3,496,670 A * 2/1970 Ryan ..... A63H 33/088 446/124
3,596,396 A * 8/1971 Thomson ..... A63F 9/088 428/542.2
4,635,411 A * 1/1987 Kurzen ..... A63H 33/10 446/112
4,676,762 A * 6/1987 Ballard ..... A63H 33/105 446/124
5,022,885 A * 6/1991 Lyman ..... A63H 33/10 446/120
5,538,452 A * 7/1996 Kurani ..... A63H 33/04 446/124

(Continued)

FOREIGN PATENT DOCUMENTS

GB 2359802 A 9/2001

OTHER PUBLICATIONS

International Search Report and Written Opinion, PCT/US2024/044634, dated Nov. 11, 2024, 9 pages.

*Primary Examiner* — Kristina R Fulton
(74) *Attorney, Agent, or Firm* — Anthony A. Laurentano; Nelson Mullins Riley & Scarborough LLP

(57) ABSTRACT

A transformable game toy is provided that includes blocks configured to be moved relative to each other to change the appearance of the transformable game toy. The blocks include first, second, third, and fourth blocks, with the second and third blocks defining internal volumes. The toy includes a first and second base member configured to be retained in the internal volumes when the toy is in a stowed state. The toy includes hinges including a first hinge attached to the first and second blocks, a second hinge attached to the second and third blocks, a third hinge attached to the third and fourth blocks, a hinge attached to the second block and first base member, and a hinge attached to the third block and second base member. The toy is adjustable from a stowed state to a fully-deployed state by moving the base members and the blocks using the hinges.

16 Claims, 22 Drawing Sheets

(56) References Cited

U.S. PATENT DOCUMENTS

| | | | | |
|---|---|---|---|---|
| 2011/0169219 | A1* | 7/2011 | Andre | A63F 9/088<br>273/153 S |
| 2017/0274292 | A1 | 9/2017 | Kanai et al. | |

* cited by examiner

TRANSFORMABLE GAME TOY

CROSS-REFERENCE TO RELATED APPLICATION(S)

This application claims priority to U.S. Provisional Patent Application No. 63/579,732, filed Aug. 30, 2023, entitled "Transformable Game Toy," which is hereby incorporated by reference in its entirety.

FIELD

The present invention relates to a transformable game toy, and more specifically relates to a transformable cube-style game toy that can be transformed into a block-like figure.

BACKGROUND

Cube-style game toys have long been a popular form of entertainment, engaging individuals of various age groups with their interactive and tactile nature. The game toys often feature movable sections that can be manipulated to create different patterns or arrangements. However, the majority of conventional cube-style game toys have been limited in their transformative capabilities and design variations.

Existing transformable toys generally rely on intricate mechanisms, complex designs, or specialized parts to achieve their transformation features. These prior art designs often result in toys that are difficult to manufacture, difficult to use, or prone to malfunctioning. Additionally, some conventional transformable toys lack a seamless transition between different forms, impeding the overall play experience. For some existing transformable toys, users find it challenging to understand the precise sequence of movements required to achieve specific shapes. Further, some existing transformable toys are relatively fragile and can be easily damaged or broken.

BRIEF SUMMARY

There thus exists a need in the art for a transformable cube-style game toy that provides a simple yet effective transformation mechanism while maintaining durability, ease of use, and aesthetic appeal.

The present invention provides a transformable game toy that can address the foregoing limitations of conventional transformable game toys by facilitating a smooth and intuitive transformation process, allowing users to effortlessly transition the transformable game toy between an original cube-like form and an alternate block-like figure arrangement. The alternate block-like figure arrangement may resemble a character in some embodiments.

Transformable game toys can provide a unique arrangement of different blocks, with the blocks generally provided in the shape of rectangular prisms. In some embodiments, four different blocks are included, and the blocks can collectively form a cube shape when the transformable game toy is in a stowed state. These blocks can be connected through selected attachment mechanisms that enable the section of the game toy to move in a selected and coordinated manner. By manipulating specific sections of the transformable game toy in a predetermined sequence, users can transform the transformable game toy from a cube-like shape (in a stowed state) to a block-like figure arrangement (in a fully deployed state), and vice versa.

The transformable cube-style game toy can offer several advantages over conventional designs. These advantages include a user-friendly and straightforward transformation process, ensuring that users of various ages can easily manipulate the transformable game toy to achieve different forms. The transformable game toy can have a robust construction, enhancing the transformable game toy's longevity and resistance to wear and tear during play. Where attachment mechanisms are provided in the form of hinges, the hinges can be configured to withstand the forces and the wear and tear that it will be subjected to, and multiple hinges can be utilized to facilitate connections in some embodiments. The transformable game toy can be easily and efficiently manufactured, allowing for mass production at a reasonable cost.

The transformable game toy can provide for a number of advantages relative to conventional game toys. For example, the transformable game toy can present a surprise factor where the user does not initially know the character or figure until the transformable game toy is unfolded into the fully deployed state. Additional design elements, such as legs, ears, hats and tails, can also be manipulated to transform a standard shape into a recognizable character figure or art sculpture. The transformable game toy can also be configured to create unlimited character figures or art sculptures by simply changing the graphic elements and/or other design elements (e.g., legs, ears, hats, tails, and the like).

The transformable game toy can have a relatively solid shape and can be manipulated and reconfigured by shifting sections of the transformable game toy to reveal a design element including shapes and graphic designs, and some of these shapes and designs can be hidden when the transformable game toy is in a stowed state. Parts of the transformable game toy can be further manipulated to expose additional graphic and figural design elements. Parts of the transformable game toy can be held together by clips/hinges and magnets as well as by an outer sticker. When the transformable game toy is in the stowed state, the graphical element can be hidden, and when the toy is unfolded into a selected figure, then the graphical element can be displayed.

Transformable game toys can differ from conventional game toys since the transformable game toy can have the ability to hide a figural character design or art sculpture design within another standard shape, such as a cube, rectangle, or sphere. The transformable game toy can also allow the user to manipulate the hinged components, parts, or sections to create other design elements, such as legs, ears, hats, and tails, and thus manipulate and transform the cube into a predetermined character, figure, or shape. In some embodiments, the transformable game toy can also employ magnets into the hinged components so that the components remain attached or connected to adjacent hinged components to add stability to the assembled figure.

In an example embodiment, a transformable game toy is provided comprising a plurality of blocks that are configured to be moved relative to each other to change the appearance of the transformable game toy. The plurality of blocks includes a first block, a second block, a third block, and a fourth block, and the second block and the third block both define internal volumes. The transformable game toy includes a first base member configured to be retained in the internal volume of the second block when the transformable game toy is in a stowed state. The transformable game toy also includes a second base member configured to be retained in the internal volume of the third block when the transformable game toy is in the stowed state. The transformable game toy also includes a plurality of hinges including a first hinge attached to the first block and the second block, a second hinge attached to the second block and the third block, a third hinge attached to the third block and the fourth block, a first base member hinge attached to the second block and the first base member, and a second base member hinge attached to the third block and the second base member. The transformable game toy is configured to be adjustable from a stowed state to a fully deployed state by moving the first base member, the second base member, and the plurality of blocks using the plurality of hinges.

In some embodiments, the plurality of blocks can collectively form a cube shape in the stowed state. In some embodiments, a geometry of the first block can mirror a geometry of the fourth block. Additionally, in some embodiments, a geometry of the second block can mirror a geometry of the third block.

In some embodiments, the transformable game toy can be configured to be moved from the stowed state to a relatively horizontal state by rotating the second block relative to the third block using the second hinge. Additionally, in some embodiments, the transformable game toy can be configured to be moved from the relatively horizontal state to an intermediate state by rotating the first block relative to the second block using the first hinge and by rotating the fourth block relative to the third block using the third hinge. Furthermore, in some embodiments, the first base member can be configured to move from a stowed position where the first base member is retained in the internal volume of the second block to an extended position where the first base member is rotated out of the internal volume of the second block, and the second base member can be configured to move from a stowed position where the second base member is retained in the internal volume of the third block to an extended position where the second base member is rotated out of the internal volume of the third block.

In some embodiments, the transformable game toy can also comprise a plurality of magnets. A first magnet of the plurality of magnets can be positioned in the first block, a second magnet of the plurality of magnets can be positioned in the fourth block, and the first magnet and the second magnet can be configured to be attracted together to assist in retaining the first block and the fourth block in contact with each other.

In some embodiments, the first base member can be configured to move from a stowed position where the first base member is retained in the internal volume of the second block to an extended position where the first base member is rotated out of the internal volume of the second block, and the second base member can be configured to move from a stowed position where the second base member is retained in the internal volume of the third block to an extended position where the second base member is rotated out of the internal volume of the third block. Additionally, in some embodiments, the transformable game toy also includes a first magnet positioned at the first base member, and a second magnet positioned at the second base member. The first magnet and the second magnet can be configured to be attracted together to assist in retaining the first base member and the second base member in contact with each other when the transformable game toy is in the fully deployed state.

In some embodiments, the transformable game toy can also optionally include a first protrusion and a second protrusion. The first block can define a first recess, and the fourth block can define a second recess. The first block can be configured to receive the first protrusion in the first recess when the transformable game toy is in the fully deployed state so that the first protrusion extends out relative to the first block, and the fourth block can be configured to receive the second protrusion in the second recess when the transformable game toy is in the fully deployed state so that the second protrusion extends out relative to the fourth block. Additionally, in some embodiments, one portion of the first protrusion can be received within the first recess when the transformable game toy is in the stowed state, and another portion of the first protrusion can be received within the second recess when the transformable game toy is in the stowed state. Furthermore, in some embodiments, one portion of the second protrusion can be received within the first recess when the transformable game toy is in the stowed state, and another portion of the second protrusion can be received within the second recess when the transformable game toy is in the stowed state. Also, in some embodiments, the first protrusion can be configured to be moved within the first recess.

In another example embodiment, a method for adjusting a transformable game toy is provided. The method comprises providing a transformable game toy. This transformable game toy comprises a plurality of blocks that are configured to be moved relative to each other to change the appearance of the transformable game toy. The plurality of blocks includes a first block, a second block, a third block, and a fourth block, and the second block and the third block both define internal volumes. The transformable game toy also includes a first base member configured to be retained in the internal volume of the second block when the transformable game toy is in a stowed state. The transformable game toy also includes a second base member configured to be retained in the internal volume of the third block when the transformable game toy is in a stowed state. The transformable game toy also includes a plurality of hinges including a first hinge connecting the first block and the second block, a second hinge connecting the second block and the third block, a third hinge connecting the third block and the fourth block, a first base member hinge connecting the second block and the first base member, and a second base member hinge connecting the third block and the second base member. The method also includes moving the transformable game toy from the stowed state to a relatively horizontal state by rotating the second block relative to the third block using the second hinge, moving the transformable game toy from the relatively horizontal state to an intermediate state by rotating the first block relative to the second block using the first hinge and by rotating the fourth block relative to the third block using the third hinge, and moving the transformable game toy from the intermediate state to the fully deployed state by rotating the first base member relative to the second block using the first base member hinge and by rotating the second base member relative to the third block using the second base member hinge. The first base member is not retained in the internal volume of the second block when the transformable game toy is in the fully deployed state, and the second base member is not retained in the internal volume of the third block when the transformable game toy is in the fully deployed state.

In some embodiments, the method can also include operations for moving the transformable game toy from the fully deployed state to the stowed state. The method can include moving the transformable game toy from the fully deployed state to the intermediate state by rotating the first base member relative to the second block using the first base member hinge so that the first base member is retained in the internal volume of the second block and by rotating the second base member relative to the third block using the second base member hinge so that the second base member is retained in the internal volume of the third block. The method can also include moving the transformable game toy from the intermediate state to the relatively horizontal state by rotating the first block relative to the second block using the first hinge and by rotating the fourth block relative to the third block using the third hinge. The method can also include moving the transformable game toy from the stowed state to a relatively horizontal state by rotating the second block relative to the third block using the second hinge.

BRIEF DESCRIPTION OF THE DRAWINGS

Reference will now be made to the accompanying drawings, which are not necessarily drawn to scale, and wherein.

DETAILED DESCRIPTION

Figure 1:
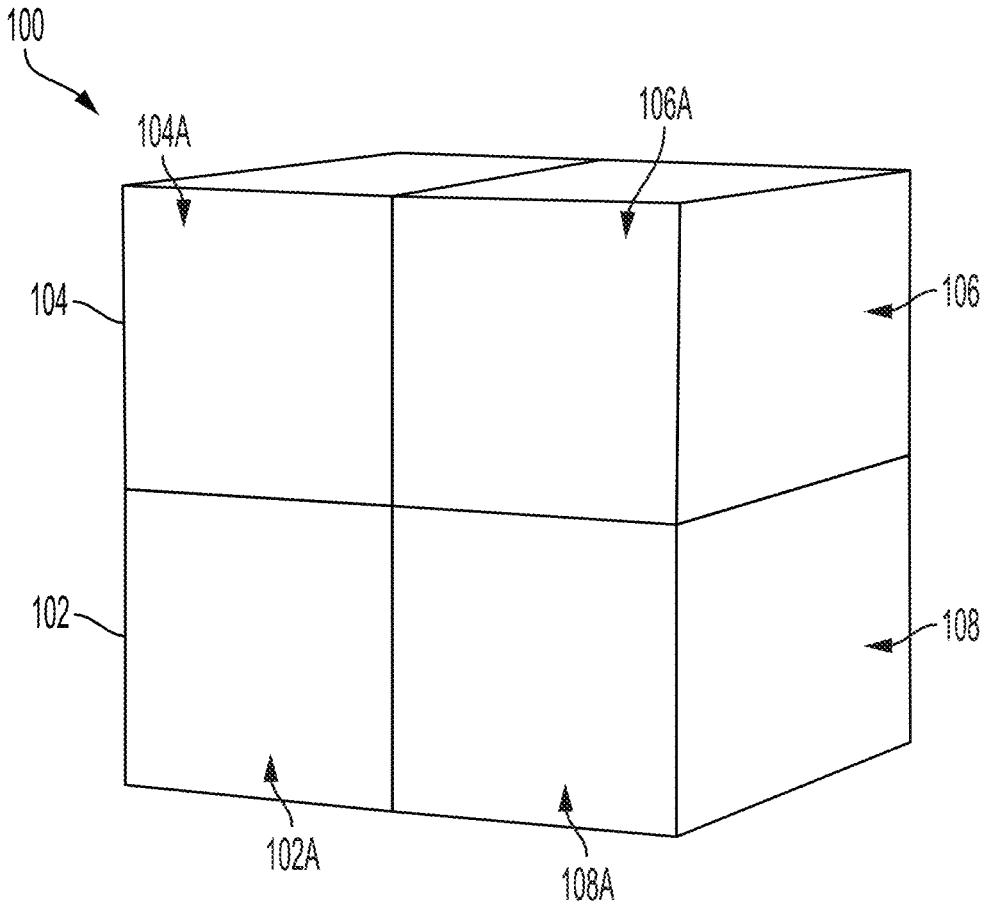
FIG. 1 is a perspective view illustrating an example transformable game toy in a stowed state, in accordance with some embodiments discussed herein.

Example embodiments now will be described more fully hereinafter with reference to the accompanying drawings, in which some, but not all embodiments are shown. Other than in FIG. 21, like reference numerals generally refer to like elements throughout. For example, reference numerals 100, 200 are used to refer to transformable game toys. Additionally, any connections or attachments can be direct or indirect connections or attachments unless specifically noted otherwise.

As used herein, the term "game toy" refers to a physical object or toy that is designed to provide entertainment, amusement, or engagement through interactive play. The game toy can include elements of challenge, strategy, creativity, or skill-based activities that encourage users to participate in enjoyable and stimulating interactions. The game toy can be designed to be manipulated by moving selected sections of the game toy relatively to each other so as to transform the game toy into a different shape or to reveal an initially hidden design element. The game toy can have any selected initial geometric configuration or shape, such as a cube, rectangle, triangle, sphere, and the like.

As used herein, the term "transformable game toy" is a specialized type of game toy that incorporates one or more mechanisms that allow or enable a user to change the physical shape, configuration, structure, or appearance of the transformable game toy by moving one or more sections or parts to form a shape or configuration that is different than the original shape. In some embodiments, a transformable game toy can be manipulated back into the original shape, and the shape transformation can involve a series of steps that alter the arrangement, shape, or components of the transformable game toy, resulting in distinct modes, forms, or states. The transformative aspect of the transformable game toy can enhance its interactive nature, providing users with the opportunity to engage in dynamic and creative play experiences as they manipulate the transformable game toy to achieve different configurations.

As illustrated in FIGS. 1-8, the transformable game toy 100 has selected components that can be moved to enable the transformable game toy 100 to move from a stowed state into a fully deployed state. FIG. 1 is a perspective view illustrating an example transformable game toy 100 in a stowed state. The transformable game toy 100 has a main body that has a cube-like shape when in the stowed state. The transformable game toy 100 can comprise a series of mechanically linked movable parts or components. The components can be folded and unfolded into a number of selected positions and configurations. According to one embodiment, the components can be grouped into a first component half (or a first movable section) and a second component half (or a second movable section). In the illustrated embodiment, the component halves each correspond to roughly half of the transformable game toy 100.

As illustrated, the transformable game toy 100 comprises a plurality of blocks. These blocks include a first block 102, a second block 104, a third block 106, and a fourth block 108. Each of the blocks 102, 104, 106, 108 define a front surface. For example, the first block 102 defines a front surface 102A, the second block 104 defines a front surface 104A, the third block 106 defines a front surface 106A, and the fourth block 108 defines a front surface 108A. The front surfaces 102A, 104A, 106A, 108A can be configured to show a face of a character thereon or some other graphic such as a pattern, a solid color, etc. Other surfaces on the blocks can similarly have graphics thereon such as a face of a character, other features of a character, or other graphics. In some embodiments, a skin may be provided on each of the surfaces 102A, 104A, 106A, 108A, and the skin may provide a graphic thereon. The skin may be provided in the form of a removable sticker or another thin layer of material that can be attached to the blocks 102, 104, 106, 108 at the surfaces 102A, 104A, 106A, 108A.

Figure 2:
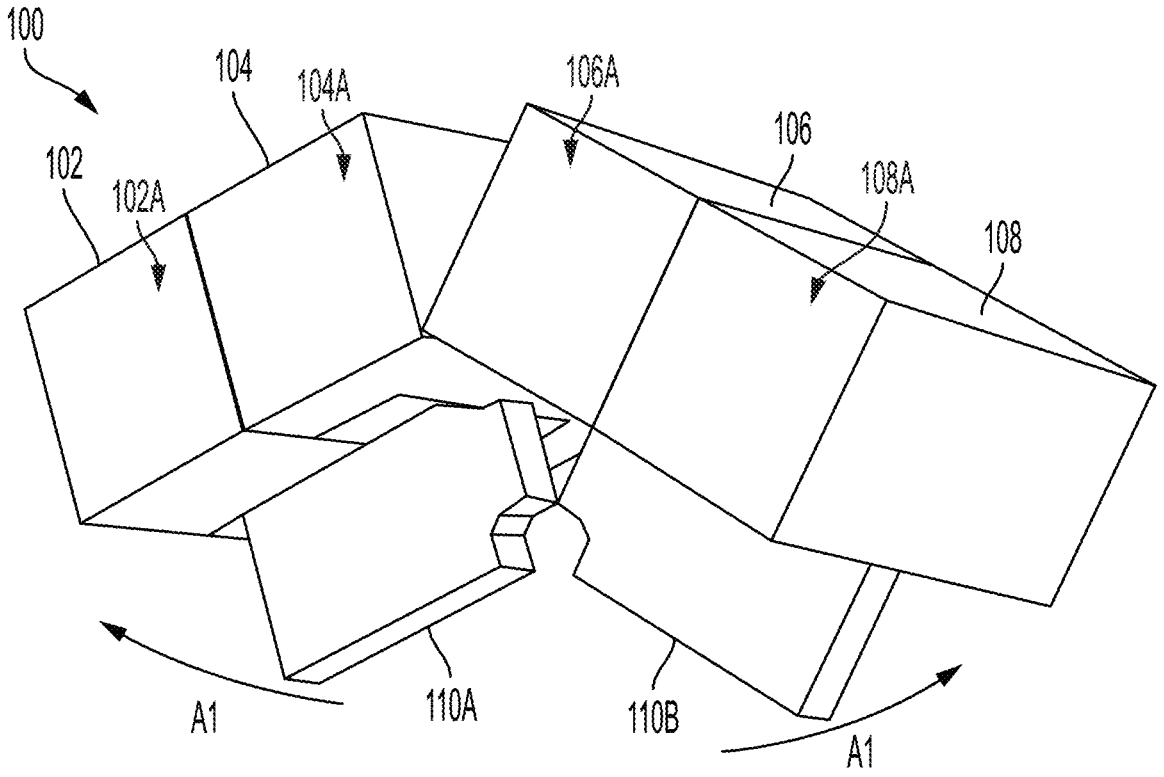
FIG. 2 is a perspective view illustrating the transformable game toy of FIG. 1 being moved from the stowed state to a relatively horizontal state, in accordance with some embodiments discussed herein.
Figure 3:
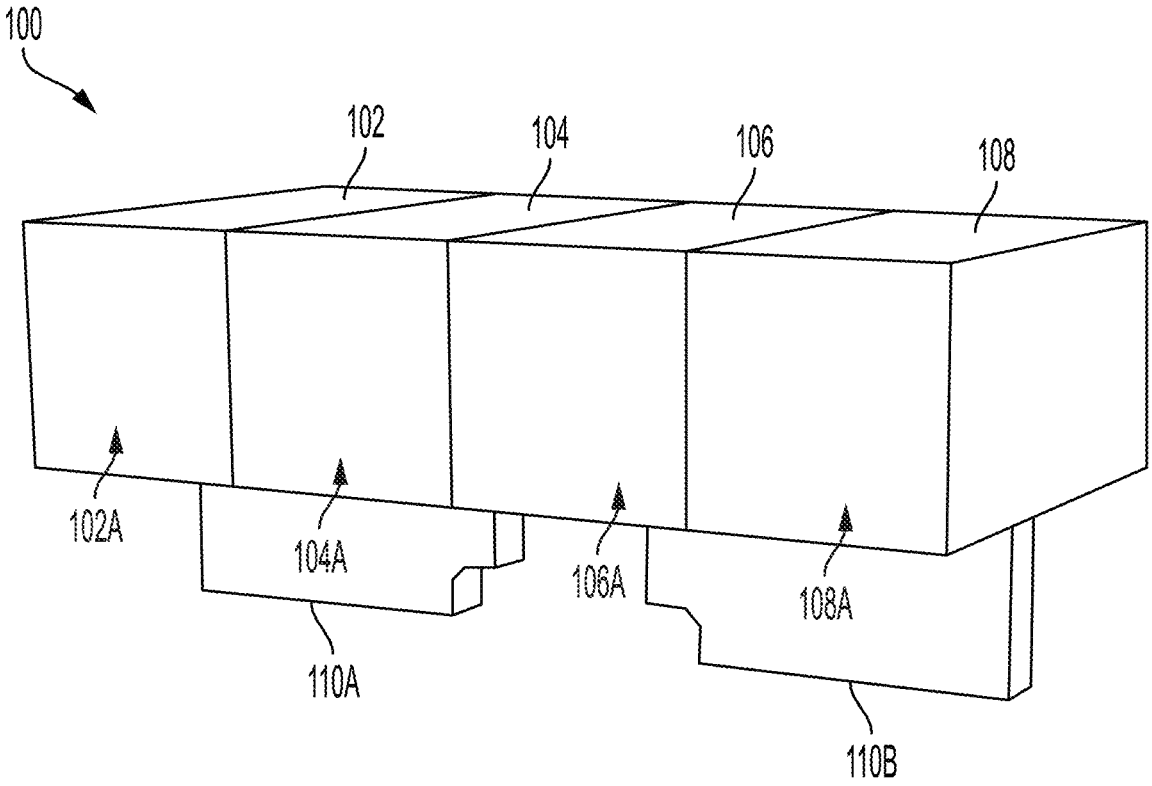
FIG. 3 is a perspective view illustrating the transformable game toy of FIG. 1 after it has been moved to a relatively horizontal state, in accordance with some embodiments discussed herein.

The transformable game toy 100 can be moved from the stowed state illustrated in FIG. 1 to a relatively horizontal state as illustrated in FIG. 3. FIG. 2 illustrates the transformable game toy 100 and the component halves of the transformable game toy 100 being moved from the stowed state to the relatively horizontal state, and FIG. 3 is a perspective view illustrating the transformable game toy 100 of FIG. 1 after the transformable game toy 100 has been moved to a relatively horizontal state.

The second block 104 and the third block 106 can be attached together via an attachment mechanism that is configured to enable movement from the stowed state of FIG. 1 to the relatively horizontal state of FIG. 3. The attachment mechanism can be a hinge, a magnet, etc. Alternatively, the attachment mechanism can be a latch, a pin, a tab, etc. that is configured to engage another corresponding attachment mechanism on another component. In some embodiments, the blocks 102, 104, 106, 108 can be releasably attachable to each other. In the transformable game toy 100, the attachment mechanism is provided in the form of a pair of hinges 123 (see FIG. 8). Where the attachment mechanism is a hinge, the first component half and the second component half can be rotated as indicated by the arrows A1 so that the transformable game toy 100 is moved to the relatively horizontal state. The first component half can include the first block 102, the second block 104, the protrusion 110A, and any other components within the first block 102 or the second block 104. The second component half can include the third block 106, the fourth block 108, the second protrusion 110B, and any other components within the third block 106 or the fourth block 108. As discussed herein, the protrusions 110A, 110B are optional features that may be omitted in other embodiments. The hinges 123 are positioned at the interface between the second block 104 and the third block 106. When the transformable game toy 100 is in a stowed state as illustrated in FIG. 1, the hinges 123 are positioned on internal faces of the blocks 104, 106 that are not visible. Where this is the case, the hinges are exposed when the transformable game toy 100 is in the relatively horizontal position of FIG. 3 or in the fully deployed state of FIG. 8 and face downwardly. However, in other embodiments, when the transformable game toy 100 is in a stowed state, hinges can be positioned on external faces of the blocks 104, 106 that are visible. Where this is the case, the hinges are not exposed when the transformable game toy 100 is in the relatively horizontal position or in the fully deployed state.

Figure 22:
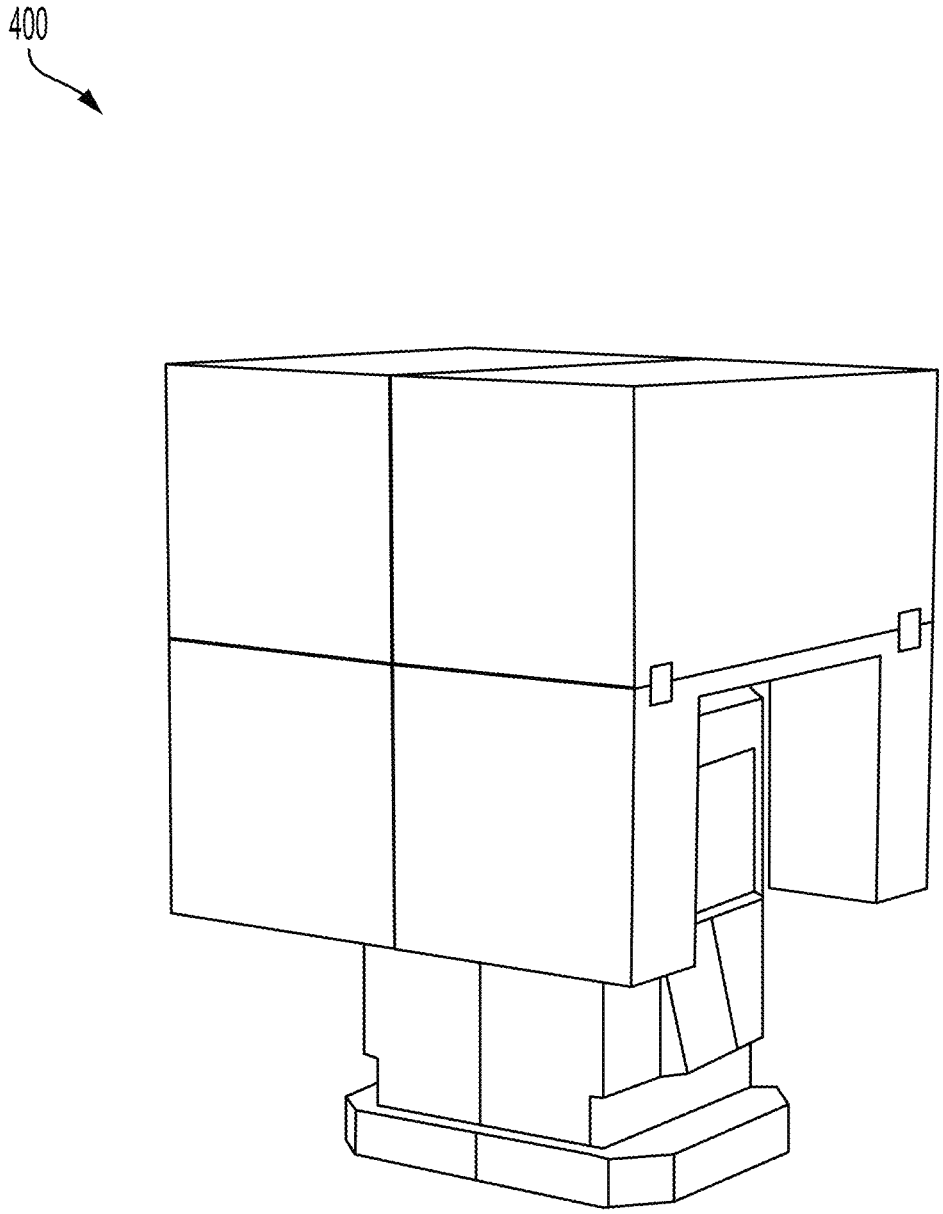
FIG. 22 is a perspective view illustrating another transformable game toy without protrusions in a fully deployed state, in accordance with some embodiments discussed herein.

Once the transformable game toy 100 begins shifting from the stowed state of FIG. 1 to the relatively horizontal state of FIG. 3, protrusions 110A, 110B can be revealed and extend outwardly from the main body of the component halves. However, when the transformable game toy 100 is in the stowed state of FIG. 1, these protrusions 110A, 110B can remain hidden. While protrusions 110A, 110B are included in the transformable game toy 100 illustrated in FIGS. 1-15, protrusions 110A, 110B can be omitted in other embodiments. For example, the transformable game toy 400 of FIG. 22 is illustrated without any protrusions. Those of ordinary skill in the art will readily recognize that the protrusions 110A, 110B can have any selected shape and size and can correspond to the final configuration or design of the game toy. For example, in the embodiment illustrated in FIG. 19, the protrusions 210A, 210B have a different shape in the form of ears for a rabbit character. In other embodiments, the protrusions can be provided in the shape of legs, hats, tails, and the like, and protrusions may possess different shapes. If the transformable game toy 100 is intended to reveal a spectral figure, then the protrusions correspond to a portion of the final figure (e.g., the ears of the final figure). The illustrated protrusions 110A, 110B extending outwardly from the components can be housed in respective recesses formed in the opposed component half. For example, the first protrusion 110A can be housed in an internal volume defined within the third block 106 and the fourth block 108, and the second protrusion 110B can be housed in an internal volume defined within the first block 102 and the second block 104. In some embodiments, the protrusions 110A, 110B can be offset from each other slightly so that they do not interfere with each other as the transformable game toy 100 moves from the relatively horizontal position to the stowed position of FIG. 1.

Figure 4:
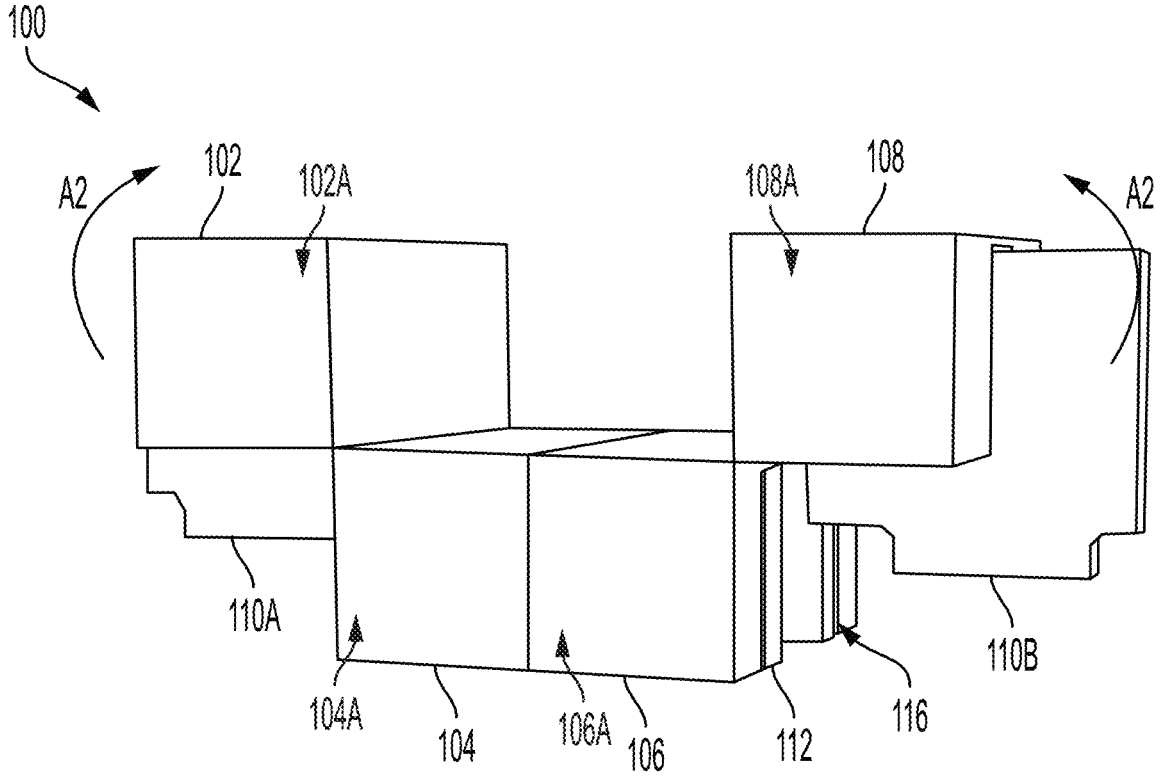
FIG. 4 is a perspective view illustrating the transformable game toy of FIG. 1 being moved from the relatively horizontal state to an intermediate state, in accordance with some embodiments discussed herein.

The transformable game toy 100 is illustrated in the perspective view of FIG. 4 when the transformable game toy 100 is in the process of being moved from a relatively horizontal state to an intermediate state. The transformable game toy 100 is illustrated in the perspective view of FIG. 5 after it has been moved to an intermediate state.

Figure 5:
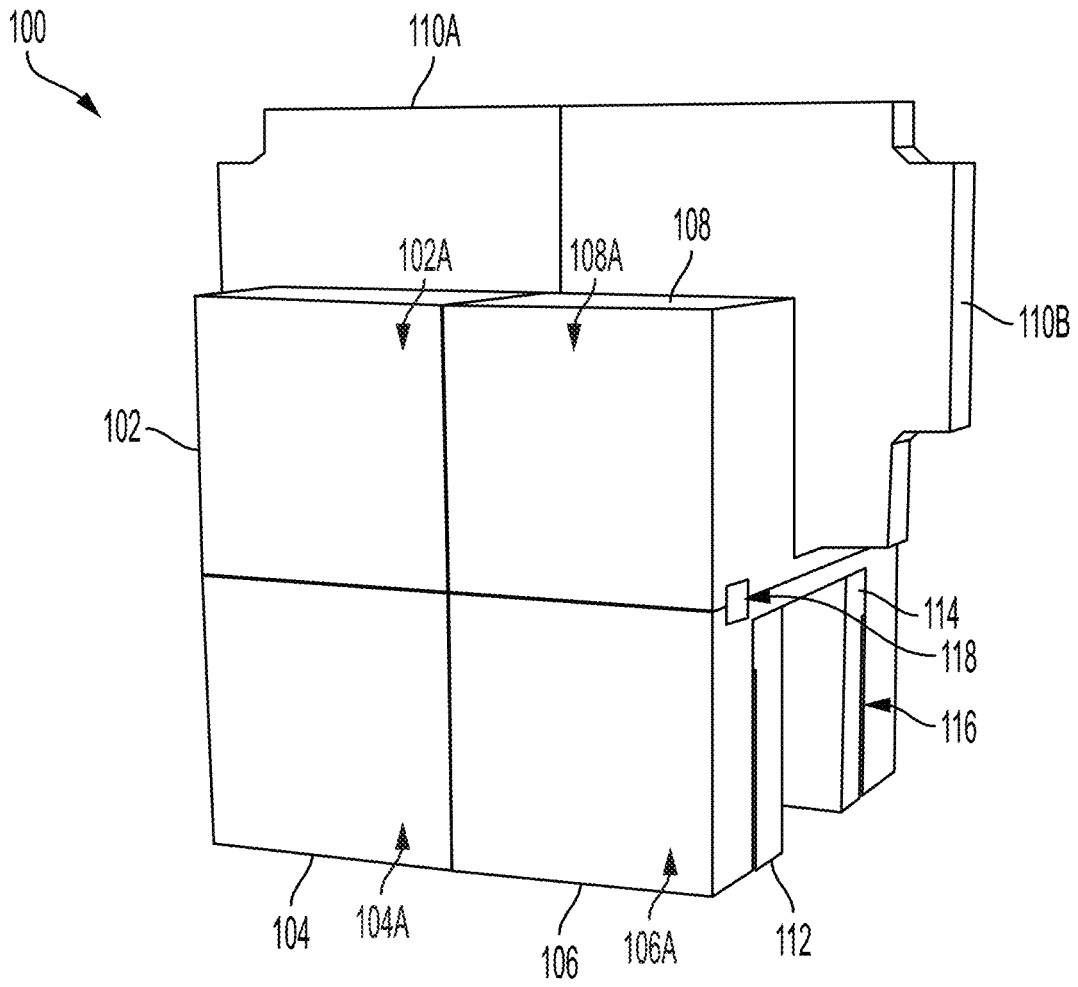
FIG. 5 is a perspective view illustrating the transformable game toy of FIG. 1 after it has been moved to an intermediate state, in accordance with some embodiments discussed herein.

As shown in FIGS. 4 and 5, each of the component halves can be formed by a pair of components, which are movable relative to each other. For example, the first component half on the left can include the first block 102, the second block 104, the first protrusion 110A, and any other components within the first block 102 or the second block 104. The second component half on the right can include the third block 106, the fourth block 108, the second protrusion 110B, and any other components within the third block 106 or the fourth block 108. In the first component half, the first block 102 and the second block 104 can be attached together via an attachment mechanism. Similarly, in the second component half, the third block 106 and the fourth block 108 can be attached together via an attachment mechanism. The attachment mechanisms can be hinge(s) or other attachment mechanisms described herein. Where the attachment mechanisms are hinge(s), the first block 102 can be rotated relative to the second block 104 about an axis defined by the hinge(s) and the fourth block 108 can be rotated relative to the third block 106 about an axis defined by the hinge(s). This rotation is indicated by the arrows A2 of FIG. 4. Where the attachment mechanisms are hinge(s), one or more hinges can be positioned on internal surfaces of the first block 102 and the second block 104 when the transformable game toy 100 is in a stowed state and one or more hinges can be positioned on internal surfaces of the third block 106 and the fourth block 108 when the transformable game toy 100 is in a stowed state. Thus, when the transformable game toy 100 is in the stowed state, these hinges can be hidden. However, in some embodiments, the hinges can be positioned on external surfaces of the blocks 102, 104, 106, 108 when the transformable game toy 100 is in a stowed state in some embodiments so that the hinges are visible in this stowed state.

In the intermediate state illustrated in FIG. 5, the protrusions 110A, 110B can extend outwardly from the first block 102 and the fourth block 108 of the transformable game toy 100. In some embodiments, the protrusions 110A, 110B are not configured to move relative to the first block 102 and the fourth block 108 respectively. However, in other embodiments, the protrusions 110A, 110B can be configured to move (e.g., rotate, slide, etc.) relative to the blocks 102, 108. For example, the protrusions 110A, 110B can be moved relative to the blocks so that the protrusions 110A, 110B extend out farther relative to the blocks. In some embodiments, the protrusions 110A, 110B can be configured to move either closer to or farther away from the front surfaces 102A, 108A, thereby allowing the protrusions to be offset from each other in a direction normal to these surfaces 102A, 108A. This can be beneficial to allow the transformable game toy 100 to be easily moved into a stowed state. However, in other embodiments, the protrusions 110A, 110B can not be configured to move in this manner.

Other features are also visible in FIG. 5 once the transformable game toy 100 has moved to the intermediate state of FIG. 5. For example, an internal volume 116 within the third block 106 is visible in FIG. 5, and a base member 112 having a bottom portion 114 is illustrated. Additionally, two hinges 118 connect the third block 106 and the fourth block 108, and these hinges 118 are visible when the transformable game toy 100 is in the intermediate state of FIG. 5. While only one hinge 118 is visible in FIG. 5, both hinges 118 that connect the blocks 106, 108 are visible in the perspective view of FIG. 7. Hinges can connect the first block 102 and the second block 104 in a manner similar to how the hinges 118 connect the third block 106 and the fourth block 108. However, other attachment mechanisms can be used in other embodiments.

Figure 6:
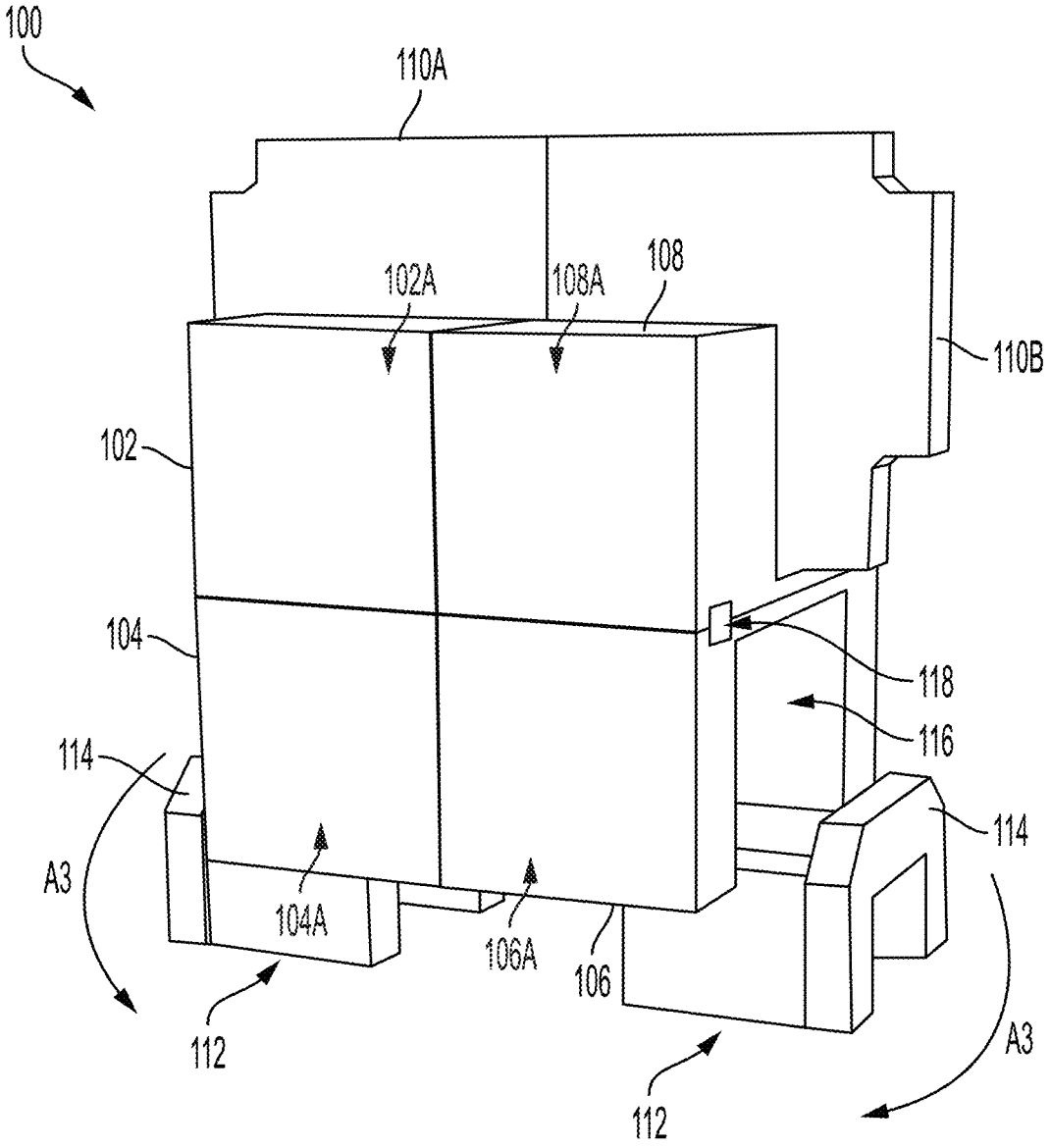
FIG. 6 is a perspective view illustrating the transformable game toy of FIG. 1 with base members being moved from a stowed position to an extended position, in accordance with some embodiments discussed herein.

The transformable game toy 100 is illustrated in the perspective view of FIG. 6 with base members 112 being moved from a stowed position to an extended position. The base members 112 can be attached to the remainder of the second block 104 and the third block 106 via an attachment mechanism. Where the attachment mechanisms are hinge(s), the base members 112 can be moved by rotating the base members about axis defined by the hinge(s) as indicated by the arrows A3. However, in some embodiments, the base members 112 can be moved in a linear manner and then can be hingedly or pivotably moved to extend vertically downward relative to a bottom surface of the transformable game toy 100. Once the base members 112 have moved to the extended position, the transformable game toy 100 is in a fully deployed state.

Figure 7:
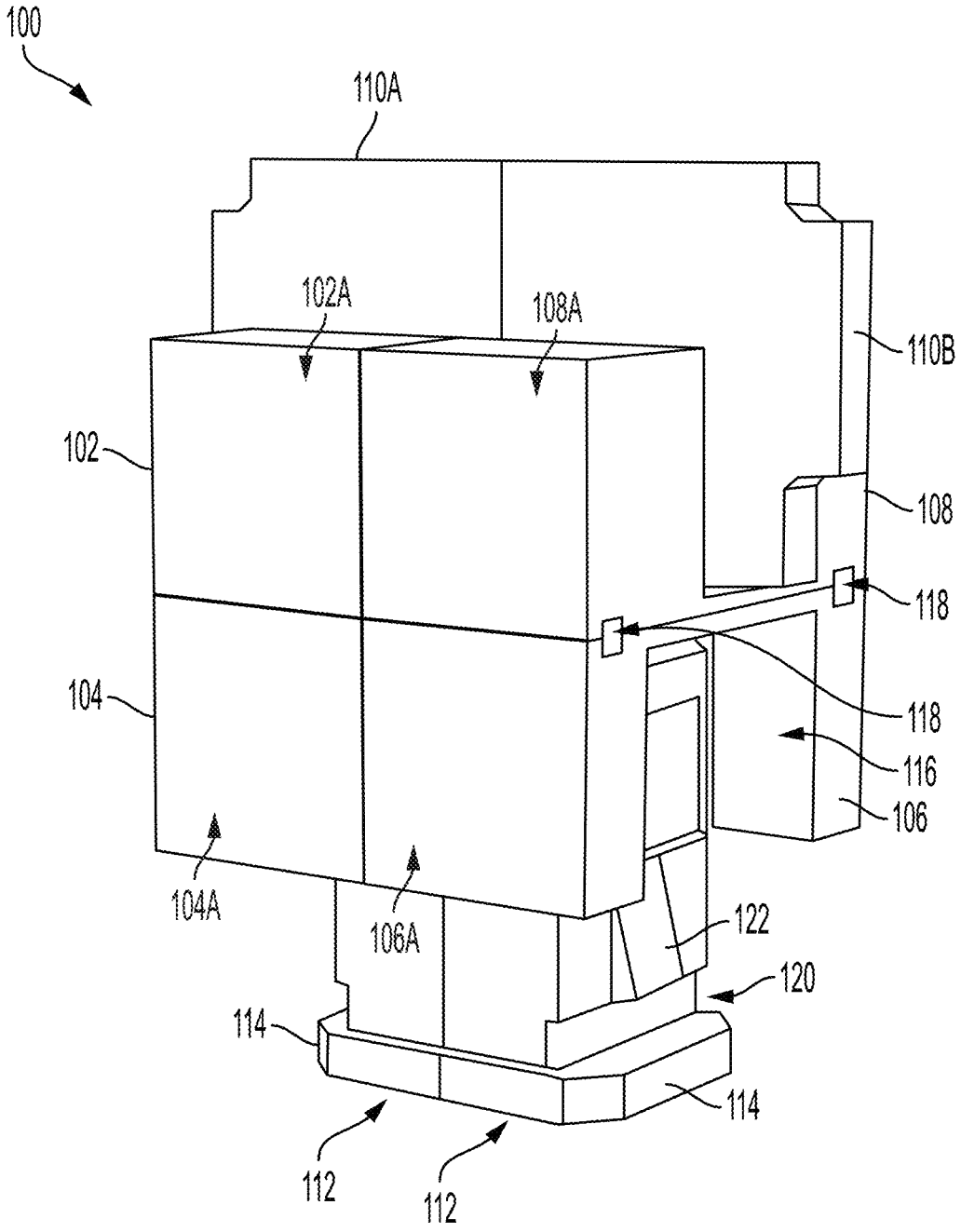
FIGS. 7 and 8 are varying perspective views illustrating the transformable game toy of FIG. 1 in a fully deployed state with base members in the extended state, in accordance with some embodiments discussed herein.
Figure 8:
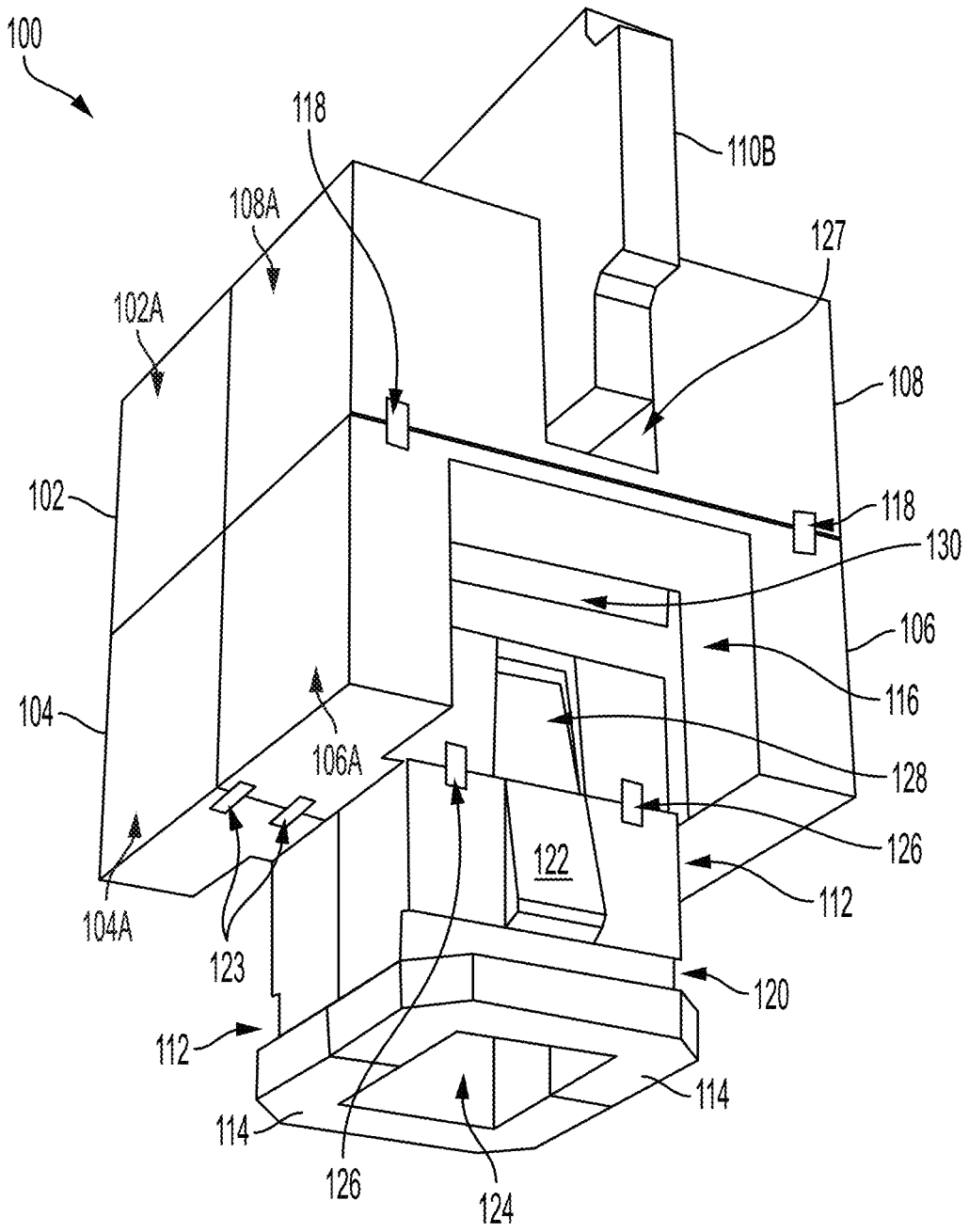

The transformable game toy 100 is illustrated in a fully deployed state in the perspective views of FIGS. 7 and 8, with base members in the extended position. These perspective views of FIGS. 7 and 8 enable other features within the transformable game toy 100 to be seen. For example, the third block 106 includes various features within the internal volume 116 that are visible in FIG. 8. For example, two hinges 126 are attached to the third block 106 and to one of the base members 112. These hinges 126 allow the base member 112 to rotate relative to the third block 106 in a manner similar to other hinges described herein. Additionally, the third block 106 defines a recess 130, and this recess 130 is positioned near the top of the internal volume 116 when the transformable game toy 100 is standing in the upright position as illustrated in FIG. 8. This recess 130 can provide additional room where the bottom portion 114 can be received when the base member 112 is moved into the internal volume 116. The recess 130 has a generally rectangular shape that is configured to easily receive the bottom portion 114, but the recess 130 can have another shape in other embodiments.

The third block 106 also defines a recess 128. This recess 128 can provide additional room where extended portion 122 of the base member 112 can be received when the base member 112 is moved into the internal volume 116. The recess 128 possesses a shape that is similar to the shape of the extended portion 122 so that the extended portion 122 can easily be received within the recess 128.

The extended portion 122 has a shape of a triangular prism, with two sides of this shape being right triangles. However, the extended portion 122 can have another shape in other embodiments. The extended portion 122 may provide the appearance of hands and/or arms for a character once the transformable game toy 100 is moved to a fully deployed state.

The base member 112 also defines a recess 120 between the bottom portion 114 and other portions of the base member 112. The recess 120 can provide clearance so that a portion of the third block 106 can be received in the recess 120. The recess 120 includes a generally rectangular shape to match the shape of the portion of the third block 106 that can be received therein, but the recess 120 can have different shapes in other embodiments.

Each of the base members 112 defines a cavity, and these cavities can be positioned adjacent to each other when the transformable game toy 100 is in the fully deployed state. The cavities 124 can provide a space where the protrusions 110A, 110B can be received when the transformable game toy 100 is in a stowed state. Additionally, the fourth block 108 includes a recess 127. The second protrusion 110B is received in the recess 127. However, the second protrusion 110B does not fill the entire recess 127, and the additional space within the recess 127 can be configured to receive a portion of the first protrusion 110A when the transformable game toy 100 is in a stowed state. The first block 102 can have a recess similar to the recess 127 that is configured to receive a portion of the second protrusion 110B when the transformable game toy 100 is in a stowed state.

In some embodiments, the transformable game toy 100 can include magnets to assist in retaining components of the transformable game toy 100 attached together. For example, magnets can be positioned in each of the base members 112

(e.g., within the bottom portion 114 of the base members). Where this is done, the base members 112 can generally remain in contact with each other once the transformable game toy 100 has been moved to the fully deployed state. However, if the user would like to move out of the fully deployed state (e.g., to move the transformable game toy 100 back to the stowed state), the user can exert a force on the base members 112 to move the base members 112 apart from each other, thereby overcoming the magnetic forces that tend to urge the base members 112 together.

In some embodiments, magnets can be positioned at other locations within the transformable game toy 100 to help retain certain components in contact with each other. Magnetic coupling can enable sections of the transformable game toy 100 to be coupled or linked together in a more robust manner. For example, looking at FIG. 1, magnets can be positioned in the first block 102 and in the fourth block 108 proximate to the interface between these two blocks 102, 108 when the transformable game toy 100 is in a stowed state (as illustrated in FIG. 1). This can allow the transformable game toy 100 to be easily retained in the stowed state. If the user would like to move the transformable game toy 100 out of the stowed state, the user can exert a force on the transformable game toy 100 (e.g., at the blocks 102, 108) to move the blocks 102, 108 apart from each other, thereby overcoming the magnetic forces that tend to urge the blocks 102, 108 together.

Additionally or alternatively, looking now at FIG. 5, magnets can be positioned in the first block 102 and in the fourth block 108 proximate to the interface between these two blocks 102, 108 when the transformable game toy 100 is in an intermediate state (as illustrated in FIG. 5) or when the transformable game toy 100 is in a fully deployed state (as illustrated in FIGS. 7 and 8). This can allow the blocks 102, 108 to be kept in contact with each other when the transformable game toy 100 is in an intermediate or fully deployed state. However, magnets can be positioned at other locations.

Additionally or alternatively, a sticker, an adhesive material, Velcro, or some other attachment feature can also serve to at least temporarily couple together selected portions or sections of the game toy. For example, one of these attachment features can be positioned at the interface between the base members 112 so that the base members 112 can be easily retained in contact with each other when the transformable game toy 100 is in a fully deployed state.

While FIGS. 1-7 illustrate a sequence for moving the components of the transformable game toy 100 from a stowed state to a fully deployed state, the sequence can be reversed so that the transformable game toy 100 is moved from the fully deployed state to the stowed state. This sequence is illustrated in FIGS. 9-14.

Figure 9:
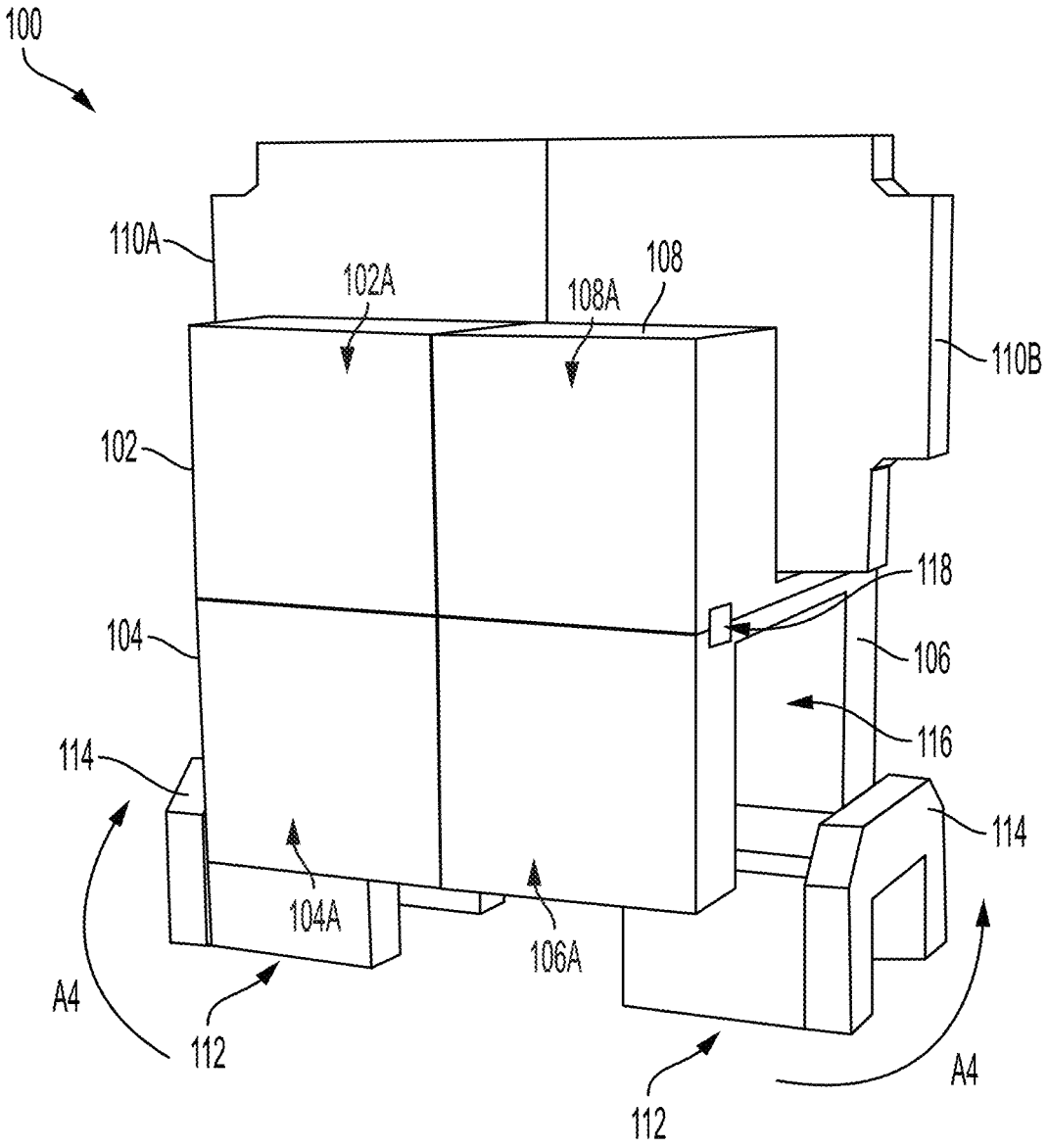
FIG. 9 is a perspective view illustrating the transformable game toy of FIG. 1 with base members being moved from the extended state to a stowed state, in accordance with some embodiments discussed herein.
Figure 10:
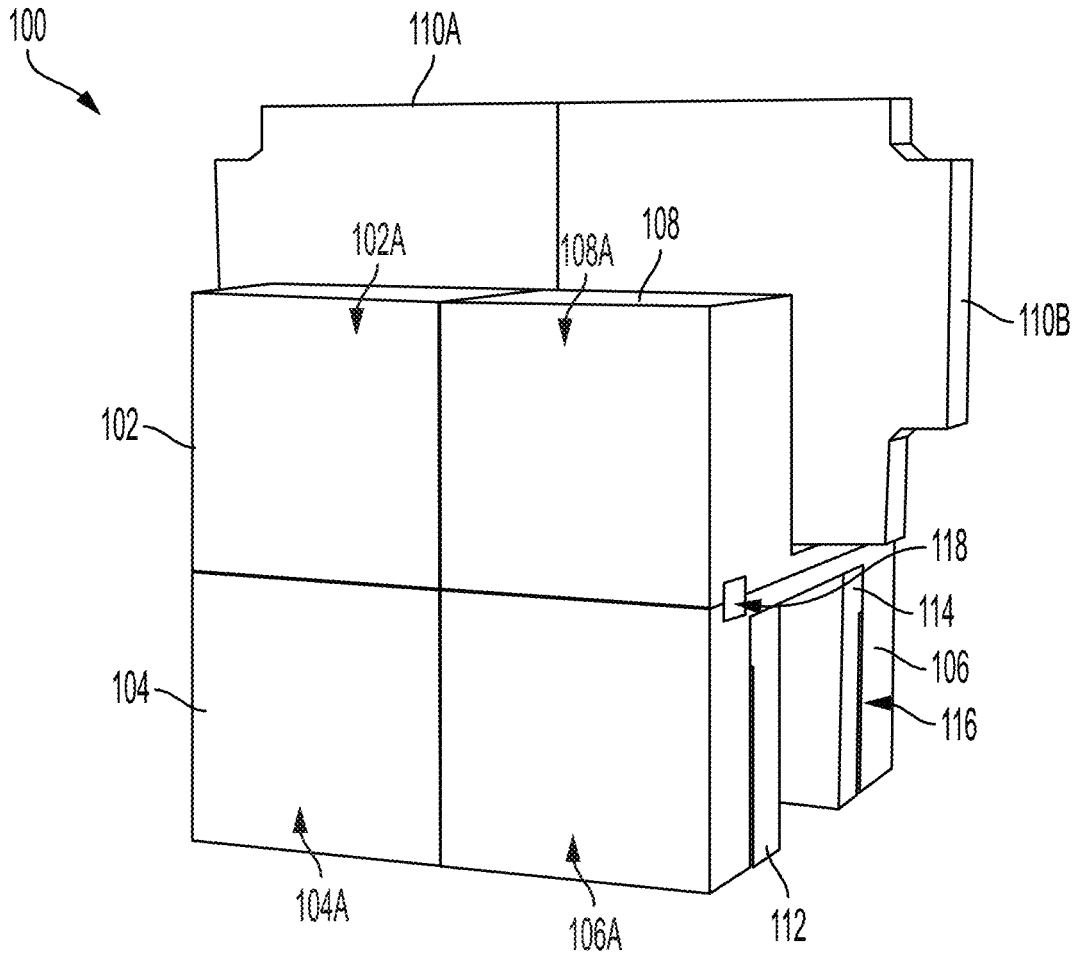
FIG. 10 is a perspective view illustrating the transformable game toy of FIG. 1 with the transformable game toy in an intermediate state and with base members in the stowed state, in accordance with some embodiments discussed herein.

The transformable game toy 100 is illustrated in the perspective view of FIG. 9 with base members 112 being moved from the extended position to the stowed position. Using the hinges 126 (see FIG. 8), the base members 112 can be rotated about an axis relative to the blocks 104, 106 as indicated by the arrows A4. In some embodiments, the base members 112 can be rotated back into the internal volume 116 formed in the second block 104 or the third block 106. The transformable game toy 100 is illustrated in the perspective view of FIG. 10 with the transformable game toy 100 in an intermediate state and with base members 112 in the stowed position.

Figure 11:
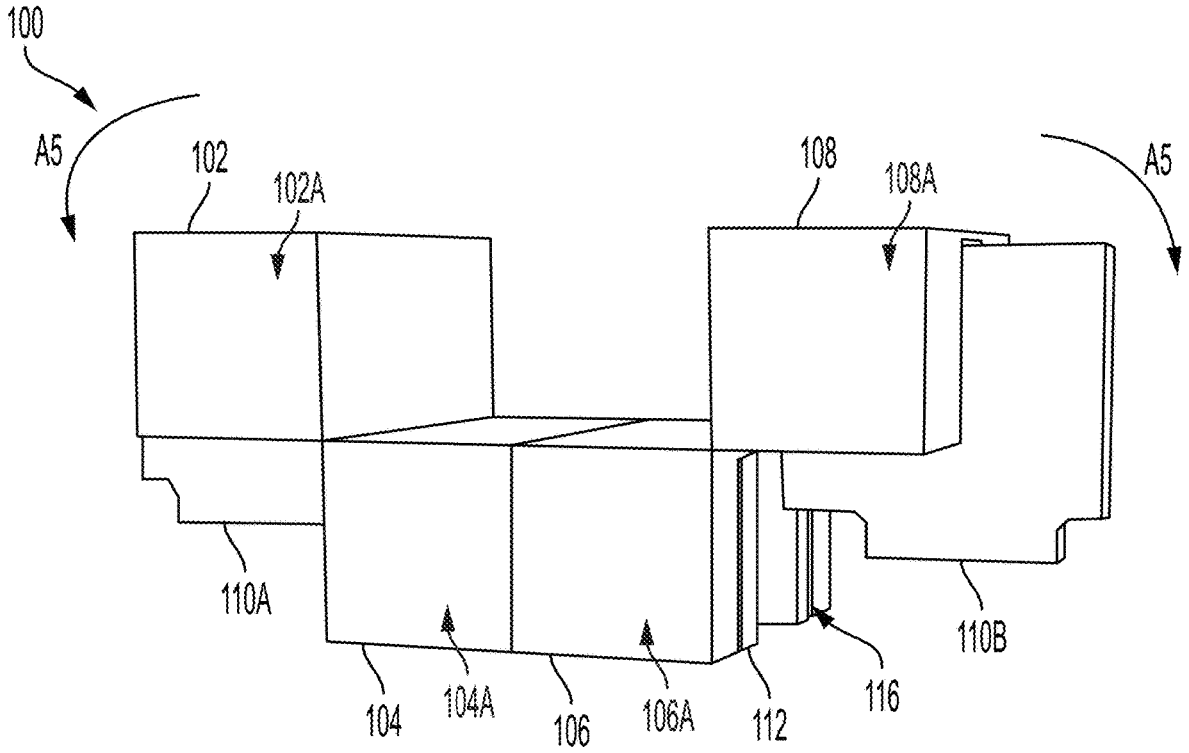
FIG. 11 is a perspective view illustrating the transformable game toy of FIG. 1 being moved from an intermediate state to a relatively horizontal state, in accordance with some embodiments discussed herein.
Figure 12:
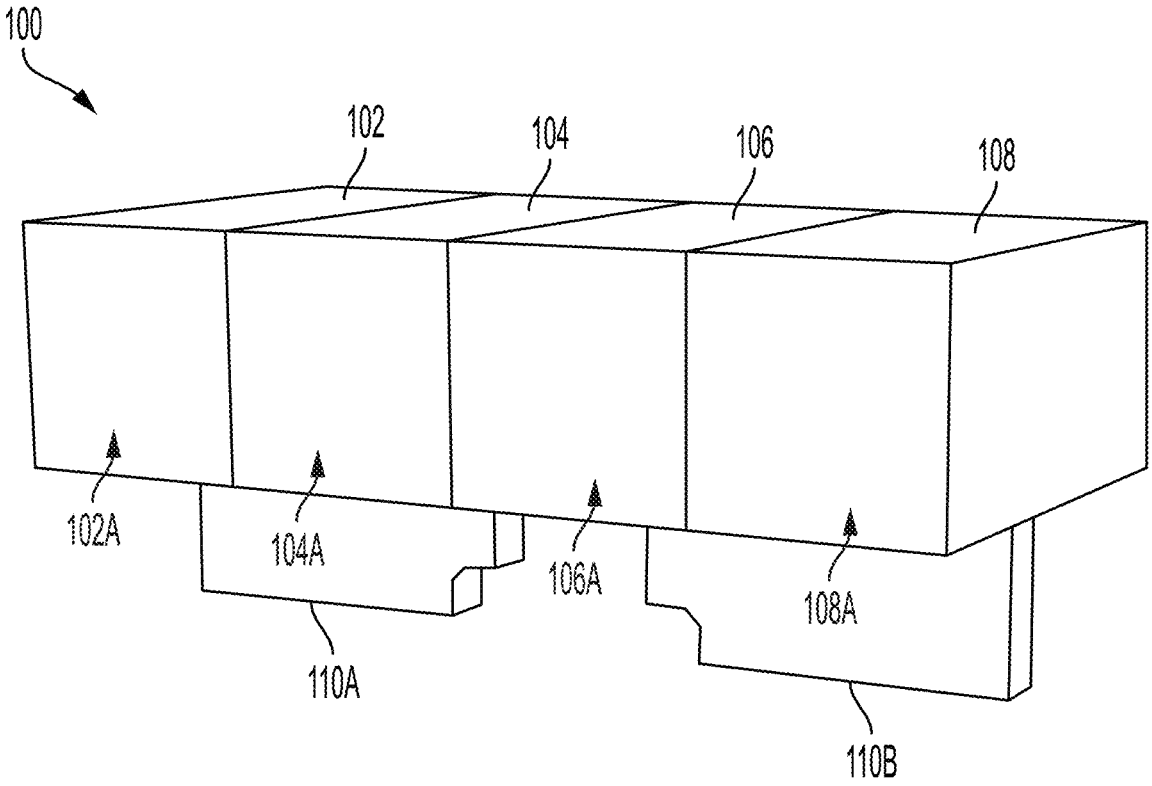
FIG. 12 is a perspective view illustrating the transformable game toy of FIG. 1 after it has been moved to a relatively horizontal state, in accordance with some embodiments discussed herein.

The transformable game toy 100 is illustrated in the perspective view of FIG. 11 when the transformable game toy 100 is being moved from an intermediate state to a relatively horizontal state. As the transformable game toy 100 moves from the intermediate state to the relatively horizontal state, the first block 102 rotates about a hinge relative to the second block 104 and the fourth block 108 rotates about a hinge 118 (see FIG. 10) relative to the third block 106, and this rotation is indicated by the arrows A5 in FIG. 11. FIG. 12 is a perspective view illustrating the transformable game toy 100 after the transformable game toy 100 has been moved from the intermediate state of FIG. 10 to the relatively horizontal state.

Figure 13:
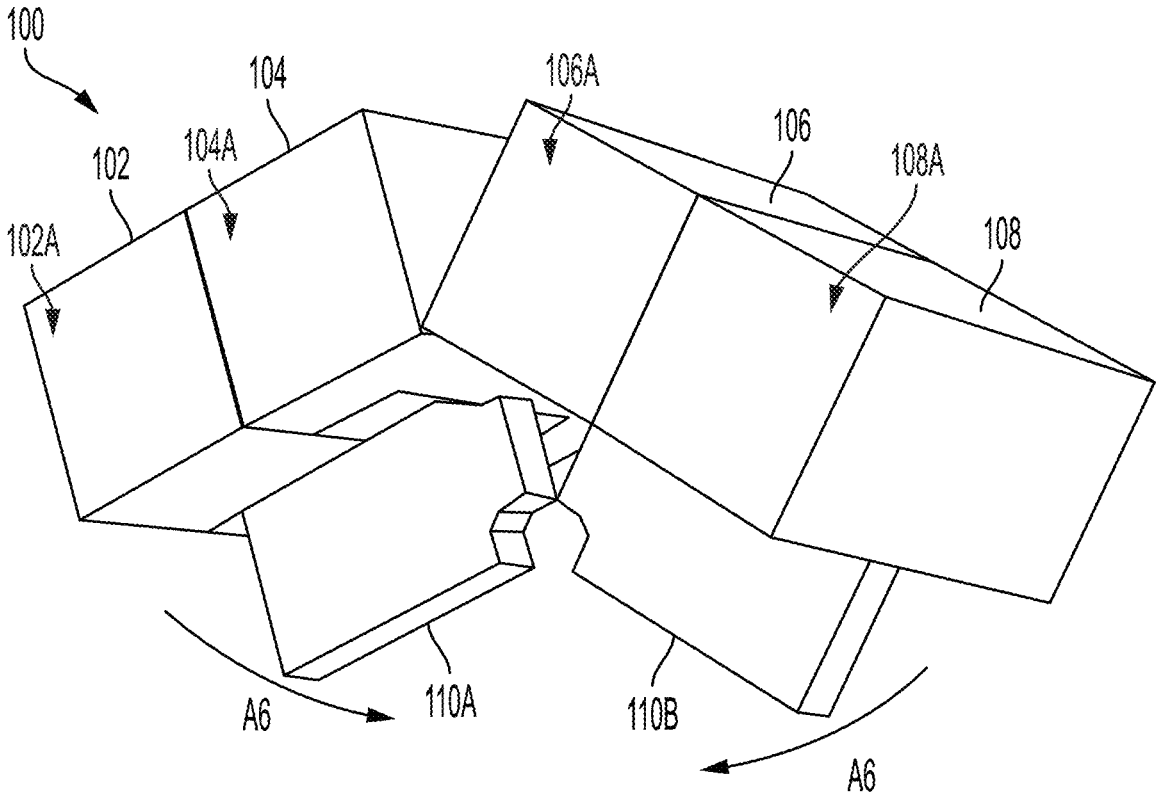
FIG. 13 is a perspective view illustrating the transformable game toy of FIG. 1 being moved from the relatively horizontal state to the stowed state, in accordance with some embodiments discussed herein.
Figure 14:
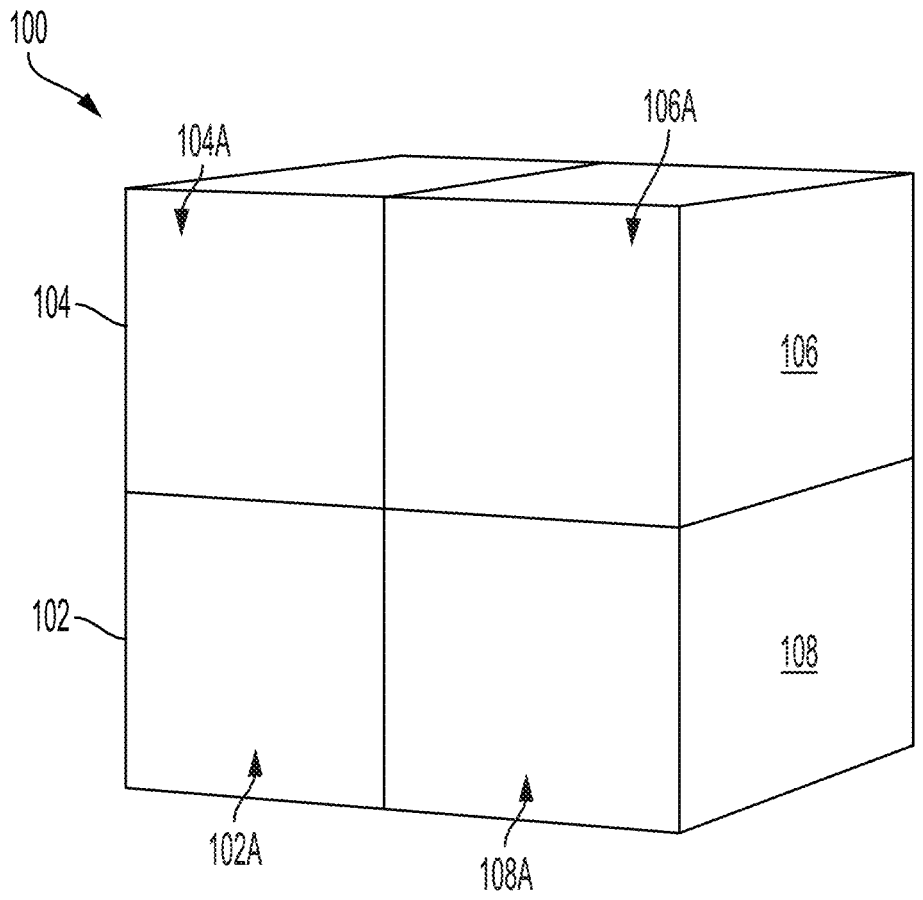
FIG. 14 is a perspective view illustrating the transformable game toy of FIG. 1 after it has returned back to the stowed state, in accordance with some embodiments discussed herein.

The transformable game toy 100 is illustrated in the perspective view of FIG. 13 when the transformable game toy 100 is being moved from the relatively horizontal state of FIG. 12 to the stowed state, and FIG. 14 is a perspective view illustrating the transformable game toy 100 of FIG. 1 after the transformable game toy 100 has returned back to the stowed state. The second block 104 and the third block 106 can be rotated about a hinge 123 (see FIG. 8) so that the first component half (which can include the first block 102, the second block 104 and components therein) and the second component half (which can include the third block 106, the fourth block 108 and components therein) can rotate together as indicated by the arrows A6. In some embodiments, the protrusions 110A, 110B can be moved within their respective recess 127 (see FIGS. 8, 16) so that a portion of the other protrusion can be received within the recess 127. For example, second protrusion 110B can be shifted closer to or farther away from the front surface 108A of the fourth block 108, thereby allowing room for part of the first protrusion 110A within the recess 127. The transformable game toy 100 can eventually return to the stowed state as illustrated in FIG. 14.

Figure 15:
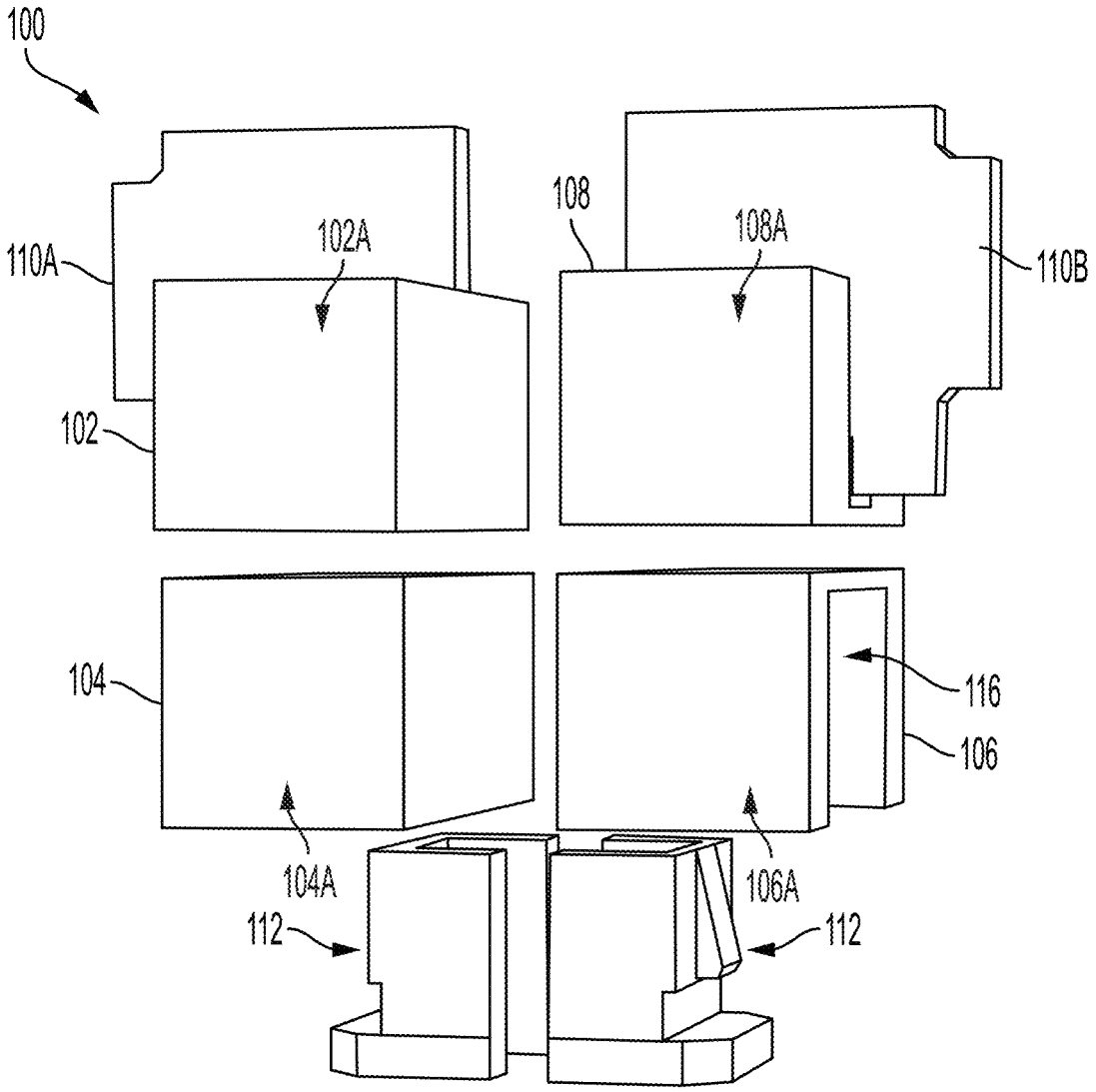
FIG. 15 is an exploded view illustrating the transformable game toy of FIG. 1, in accordance with some embodiments discussed herein.

FIG. 15 is an exploded view illustrating the transformable game toy 100. The transformable game toy 100 includes the first block 102 and the first protrusion 110A. The first protrusion 110A can be considered to be part of the first block 102 in some embodiments, but the first protrusion 110A can be considered to be a separate component from the first block 102 in some embodiments.

The transformable game toy 100 also includes the fourth block 108 and the second protrusion 110B. The second protrusion 110B can be considered to be part of the fourth block 108 in some embodiments, but the second protrusion 110B can be considered to be a separate component from the fourth block 108 in some embodiments.

The transformable game toy 100 also includes a second block 104 and a third block 106. The geometry of the second block 104 can mirror the geometry of the third block 106, and both blocks 104, 106 can define an internal volume 116 therein. The transformable game toy 100 also includes two base members 112. One base member 112 can be received in the internal volume of the second block 104, and another base member 112 can be received in the internal volume 116 of the third block 106.

Figure 16:
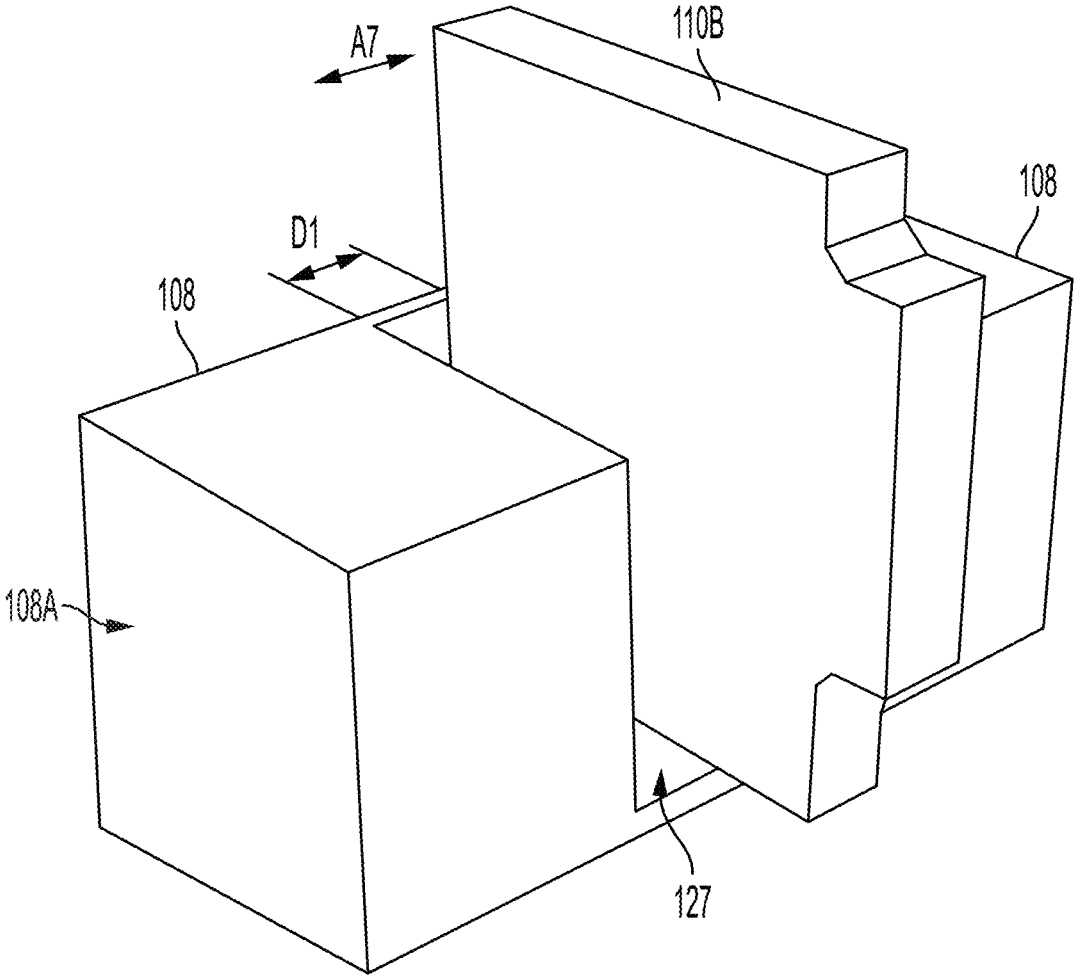
FIG. 16 is a perspective view illustrating an example block of the transformable game toy of FIG. 1 having protrusions extending from the block, in accordance with some embodiments discussed herein.

The fourth block 108 is illustrated in isolation in FIG. 16. The geometry of the first block 102 can mirror the geometry of the fourth block 108. The fourth block 108 includes a recess 127. The second protrusion 110B is received in the recess 127. However, the second protrusion 110B does not fill the entire recess 127, and the additional space within the recess 127 can be configured to receive a portion of the first protrusion 110A (see FIG. 13) when the transformable game toy 100 is in a stowed state. The first block 102 can have a recess similar to the recess 127 that is configured to receive a portion of the second protrusion 110B when the transformable game toy 100 is in a stowed state. In some embodiments, the second protrusion 110B can be moved towards the front surface 108A or away from the front surface 108A as indicated by the arrows A7. When the second protrusion 110B is moved as far as possible away from the front surface 108A within the recess 127, the second protrusion 110B can be offset from a first end of the recess 127 by a distance D1. This distance D1 can be approximately equal to or slightly larger than the thickness of each of the protrusions 110A, 110B so that portions of both of the protrusions 110A, 110B can fit within the recess 127.

Figure 17:
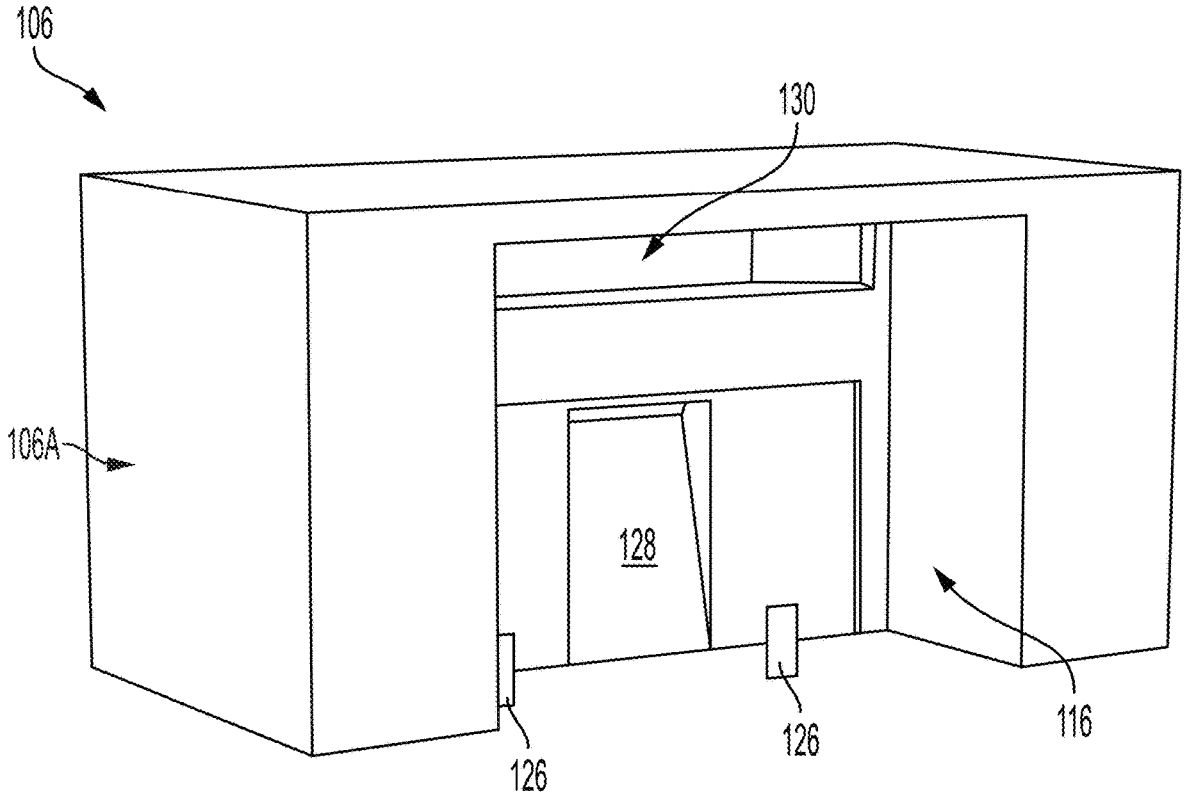
FIG. 17 is a perspective view illustrating an example block of the transformable game toy of FIG. 1 having an internal volume formed therein, in accordance with some embodiments discussed herein.

The third block 106 is illustrated in isolation in the perspective view of FIG. 17 so that features within the internal volume 116 can be more easily seen. As noted above, the third block 106 defines a recess 128 and a recess 130. Additionally, the third block 106 includes two hinges 126 partially positioned in the internal volume 116, with these hinges 126 also being attached to a respective base member 112 to allow the base member 112 to rotate relative to the third block 106. The geometry of the second block 104 can mirror the geometry of the third block 106.

Figure 18:
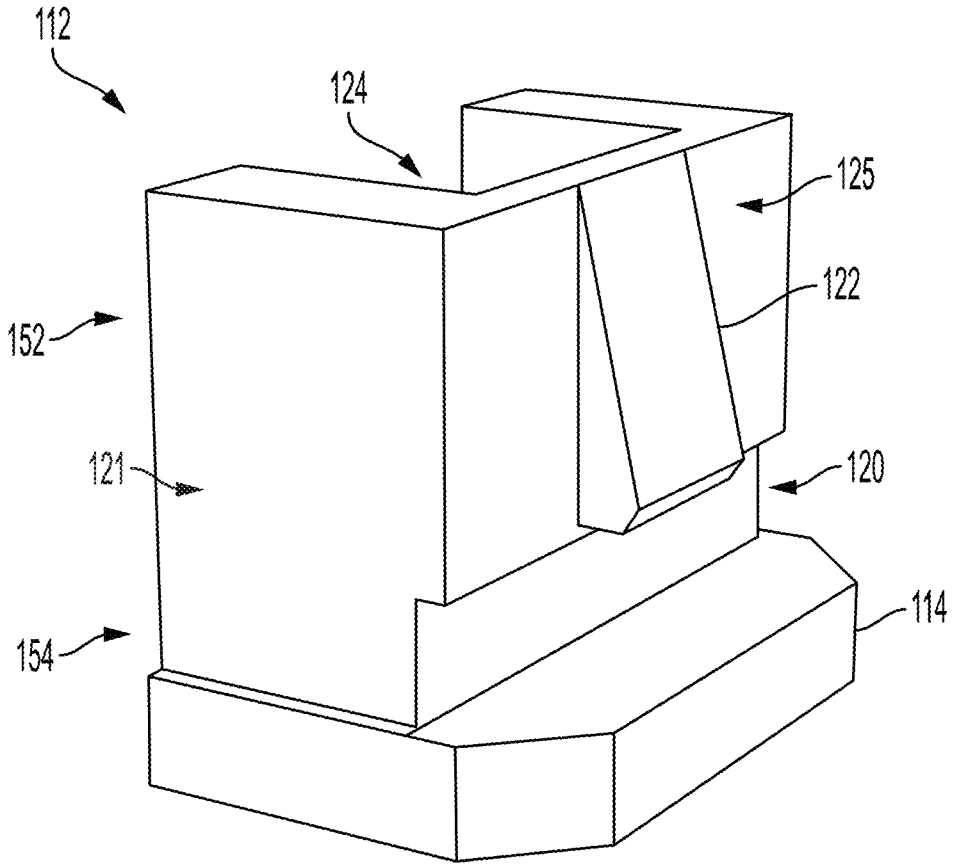
FIG. 18 is a perspective view illustrating an example base member of the transformable game toy of FIG. 1, in accordance with some embodiments discussed herein.

A base member 112 of the transformable game toy 100 is illustrated in isolation in the perspective view of FIG. 18. The extended portion 122 of the base member 112 extends outwardly relative to the surface 125 of the base member 112.

The base member 112 also defines a front surface 121. The front surface 121 can be configured to show a portion of a character thereon or some other graphic such as a pattern, illustrated clothing, a solid color, etc. Additionally, the front surface 121 includes an upper portion 152 and a lower portion 154. The lower portion 154 is positioned proximate to the recess 120. As a result, the upper portion 152 has a larger width than the lower portion 154 when viewed from the front of the base member 112 or from the front of the transformable game toy 100.

When the transformable game toy 100 is in a fully deployed state, the blocks 102, 104, 106, 108 can collectively provide the appearance of a head of the character that is portrayed, and the base member 112 can provide the appearance of other portions of the body of the character that is portrayed. For example, the upper portion 152 of the front surface 121 can serve as the upper body for the character, the extended portion 122 can serve as the arms and/or hands for the character, the lower portion 154 can serve as the legs for the character, and bottom portion 114 can serve as the feet of the character. While each of these features are illustrated as having a particular geometry, the geometry of these features can be different in other embodiments, thereby providing a different appearance for the character.

Figure 19:
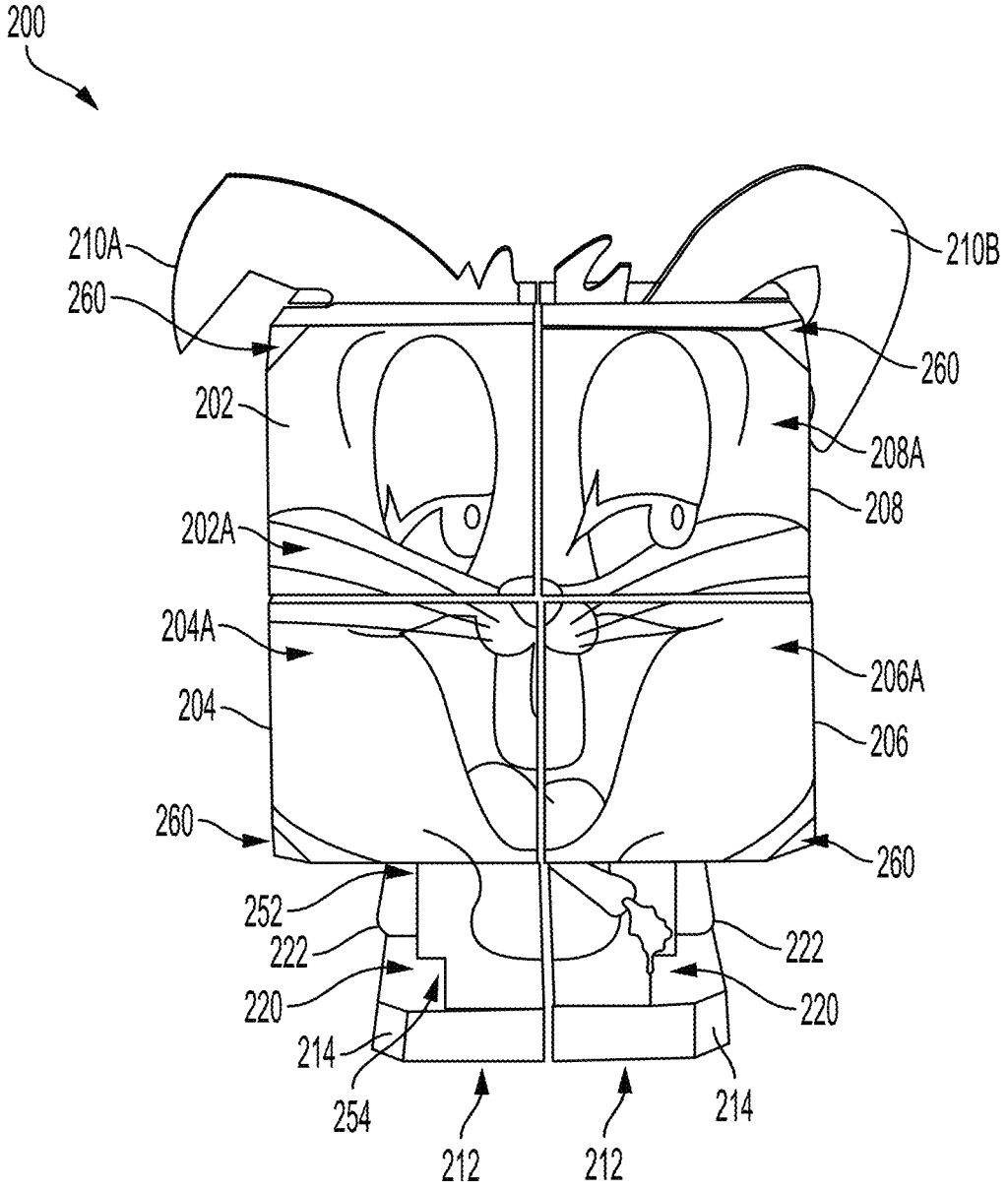
FIG. 19 is a front, perspective view illustrating an example transformable game toy in a fully deployed state, in accordance with some embodiments discussed herein.

FIG. 19 is a front, perspective view illustrating another example transformable game toy 200 in a fully deployed state. When the transformable game toy 200 is manipulated and moved into the fully deployed state, a predetermined character or figure can be revealed, as shown for example in FIG. 19. Similarly, the transformable game toy 200 can be shipped or packaged in the stowed state, or the transformable game toy 200 can be folded back into the stowed state from the fully deployed state.

The transformable game toy 200 can move from the stowed state to the fully deployed state and vice versa in a manner similar to the transformable game toy 100. The transformable game toy 200 includes various features that are generally similar to the corresponding features of the transformable game toy 100. Transformable game toy 200 includes a first block 202 having a front surface 202A, a second block 204 having a front surface 204A, a third block 206 having a front surface 206A, and a fourth block 208 having a front surface 208A, and each of these can be generally similar to the corresponding block 102, 104, 106, 108 within the transformable game toy 100. However, the blocks 202, 204, 206, 208 each have chamfered corners 260. A face of a character can be represented on the surfaces 202A, 204A, 206A, 208A, and the chamfered corners 260 can give the face of the character on the surfaces 202A, 204A, 206A, 208A a more rounded appearance relative to other embodiments where the chamfered corners 260 are not present. Rounded corners may be used instead of chamfered corners in some embodiments.

Protrusions 210A, 210B are provided in the transformable game toy 200 that generally operate in a similar manner relative to the protrusions 110A, 110B in the transformable game toy 100. However, the protrusions 210A, 210B have a different geometry relative to the protrusions 110A, 110B, with the protrusions 210A, 210B shaped like rabbit ears. However, the protrusions that are used can be modified to a wide variety of different geometries as described herein.

Additionally, the base member 212 is provided that is generally similar to the base member 112 of other embodiments. The base member 212 includes a bottom portion 214, an extended portion 222, an upper portion 252, and a lower portion 254. These features can be similar to the corresponding components within the base member 112. As can be seen from the perspective illustrated in FIG. 19, the upper portion 252 can serve as the upper body for the character, the extended portion 222 can serve as the arms for the character, the lower portion 254 can serve as the legs for the character, and bottom portion 214 can serve as the feet of the character. Also, the base member 212 defines a recess 220 proximate to the lower portion 254 so that the lower portion 254 has a reduced width relative to the upper portion 252.

Figure 20:
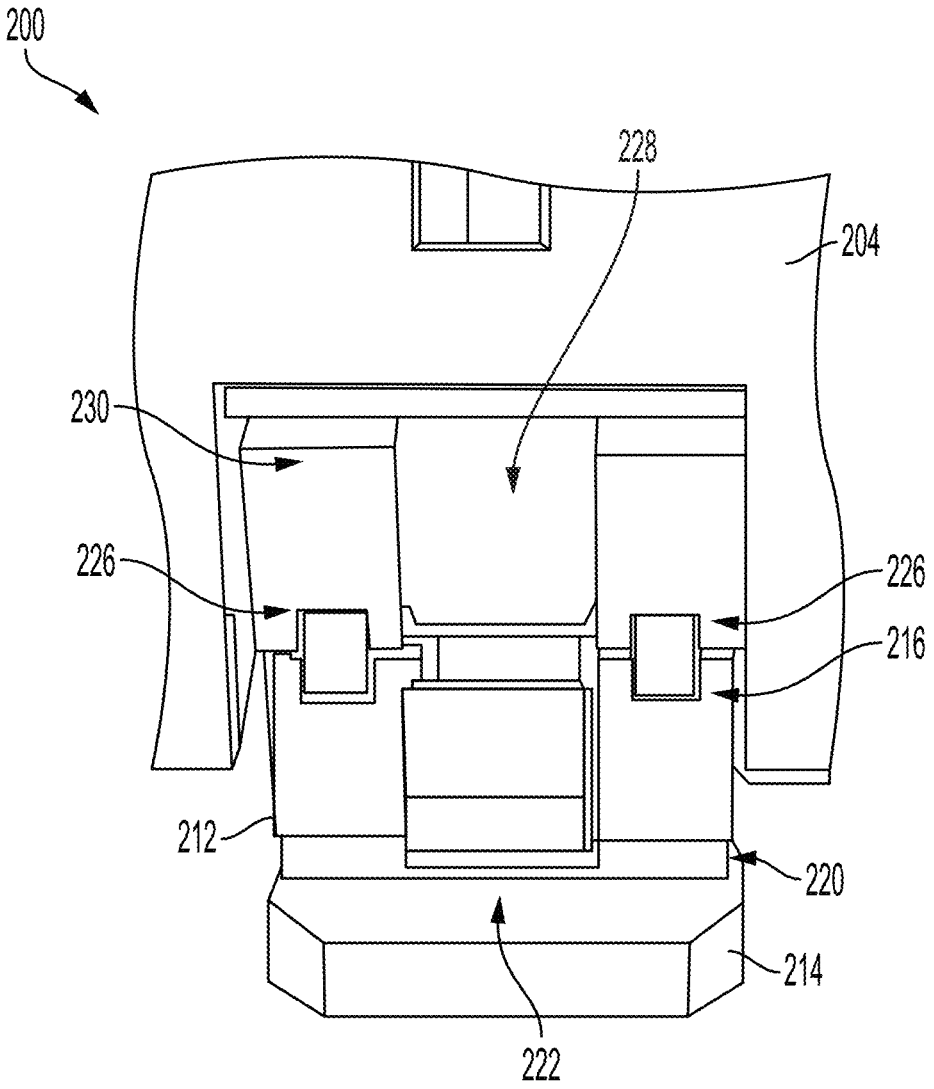
FIG. 20 is a side view illustrating the transformable game toy of FIG. 19 when the transformable game toy is in a fully deployed state, in accordance with some embodiments discussed herein.

FIG. 20 is a side view illustrating the transformable game toy 200 of FIG. 19 when the transformable game toy 200 is in a fully deployed state. This allows features of the base member 212 and features within the internal volume 216 of the second block 204 to be seen. These features can generally be similar to the features in the third block 106 and the base member 112 illustrated in FIG. 8. The base member 212 can include a bottom portion 214, a recess 220, and an extended portion 222, and each of these features can be similar to the corresponding features within the base member 112. Hinges 226 are also illustrated that are connected to the second block 204 at one end and that are connected to the base member 212 at the other end, thereby allowing the base member 212 to be rotated relative to the second block 204.

Additionally, the second block 204 defines a recess 228 configured to receive a portion of the extended portion 222 when the base member 212 is moved to a stowed position, and the second block 204 defines a recess 230 configured to receive part of the bottom portion 214 when the base member 212 is moved to a stowed position. The recess 228 and the recess 230 are generally similar to the corresponding recesses 128, 130 of the third block 106.

Figure 21:
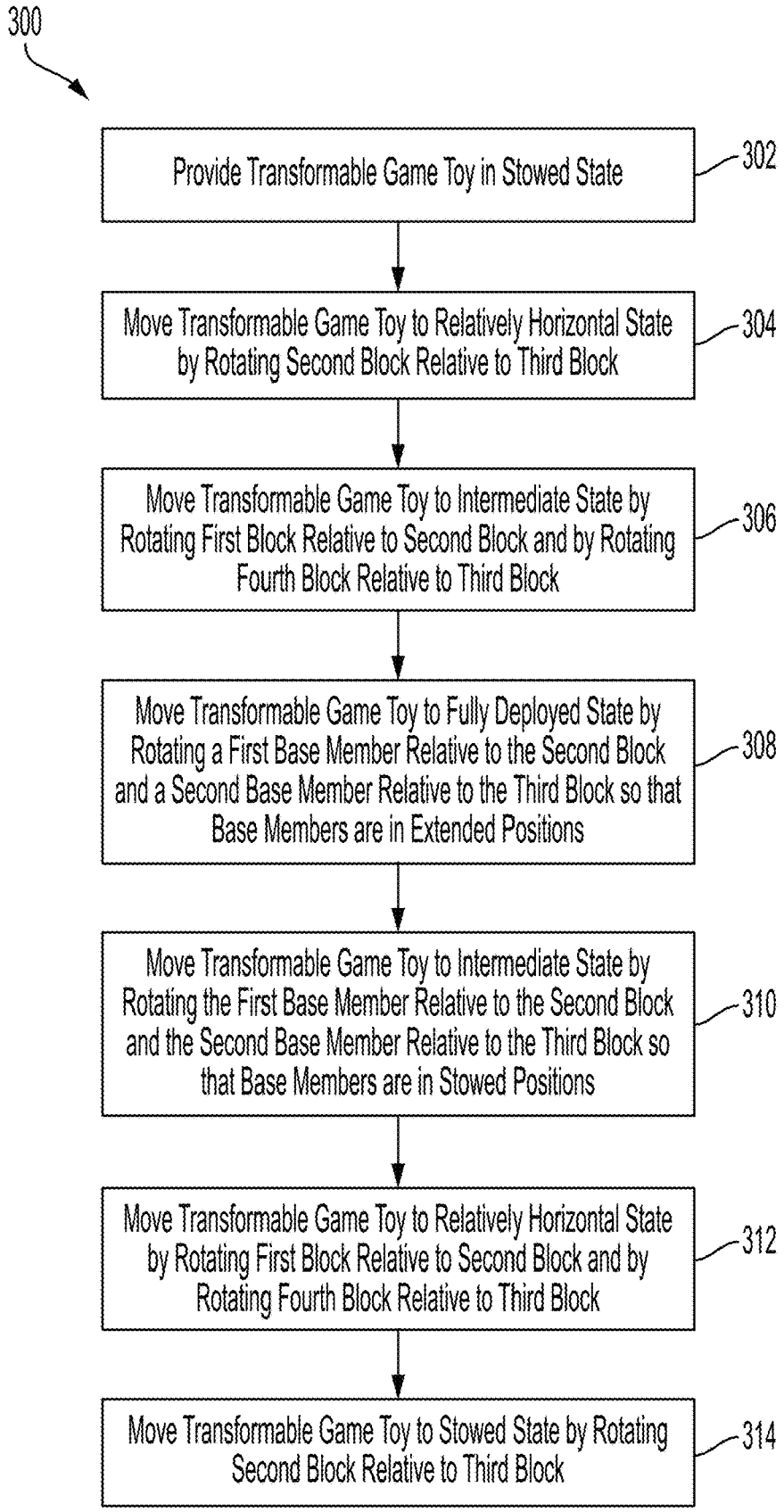
FIG. 21 is a flow chart illustrating an example method for adjusting a transformable game toy from a stowed state to a fully deployed state and then back to the stowed state, in accordance with some embodiments discussed herein.

FIG. 21 is a flow chart illustrating an example method for adjusting a transformable game toy from a stowed state to a fully deployed state and then back to the stowed state. At operation 302, the transformable game toy can be provided, and the transformable game toy can be provided in a stowed state in some embodiments. The transformable game toy can include a plurality of blocks that are configured to be moved relative to each other to change the appearance of the transformable game toy. The plurality of blocks can include a first block, a second block, a third block, and a fourth block. The second block and the third block can each define internal volumes. The transformable game toy can also include a first base member. The first base member can be configured to be retained in the internal volume of the second block when the transformable game toy is in a stowed state. The transformable game toy can also include a second base member. The second base member can be configured to be retained in the internal volume of the third block when the transformable game toy is in a stowed state. The transformable game toy can also include a plurality of hinges, including a first hinge, a second hinge, a third hinge, a first base member hinge, and a second base member hinge. The first hinge can connect the first block and the second block, the second hinge can connect the second block and the third block, the third hinge can connect the third block and the fourth block, the first base member hinge can connect the second block and the first base member, and the second base member hinge can connect the third block and the second base member.

At operation 304, the transformable game toy can be moved to a relatively horizontal state. This can be accomplished by rotating or otherwise moving the second block relative to the third block using the second hinge.

At operation 306, the transformable game toy can be moved from the relatively horizontal state to an intermediate state. This can be accomplished by rotating or otherwise moving the first block relative to the second block using the first hinge and by rotating or otherwise moving the fourth block relative to the third block using the third hinge.

At operation 308, the transformable game toy can be moved from the intermediate state to a fully deployed state. This can be accomplished by rotating a first base member relative to the second block using the first base member hinge and by rotating a second base member relative to the third block using the second base member hinge so that base members are in extended positions. After operation 308 is completed, the transformable game toy 308 can be in a fully deployed state. When the transformable game toy is in the fully deployed state, the first base member is not retained in the internal volume of the second block and the second base member is not retained in the internal volume of the third block.

The transformable game toy 308 can also be moved back to a stowed state by completing operations 310, 312, and 314. At operation 310, the transformable game toy can be moved from the fully deployed state to the intermediate state. This can be accomplished by rotating the first base member relative to the second block using the first base member hinge and by rotating the second base member relative to the third block using the second base member hinge so that base members are in stowed positions, with the first and second base members being retained in the internal volumes within the second and third blocks respectively.

At operation 312, the transformable game toy can be moved from the intermediate state to a relatively horizontal state. This can be accomplished by rotating the first block relative to the second block using the first hinge and by rotating the fourth block relative to the third block using the third hinge.

At operation 314, the transformable game toy can be moved from the relatively horizontal state to a stowed state. This can be accomplished by rotating the second block relative to the third block using the second hinge.

The method 300 illustrated in FIG. 21 is merely exemplary, and the method 300 can be modified in various ways. For example, the method 300 can be modified by adding additional operations, or the method 300 can be modified by omitting other operations. In some embodiments, only operations 302, 304, 306, 308 are performed or only operations 310, 312, 314 are performed. Additionally or alternatively, the operations can be performed in different orders, and some operations can be performed simultaneously in some embodiments. For example, operations 306 and 308 can be performed simultaneously in some embodiments so that base members are moved to extended positions while the transformable game toy moves from a relatively horizontal state to an intermediate state.

CONCLUSION

Many modifications and other embodiments set forth herein will come to mind to one skilled in the art to which these embodiments pertain having the benefit of the teachings presented in the foregoing descriptions and the associated drawings. Therefore, it is to be understood that the embodiments are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions can be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A transformable game toy comprising:

a plurality of blocks that are configured to be moved relative to each other to change the appearance of the transformable game toy, wherein the plurality of blocks includes a first block, a second block, a third block, and a fourth block, wherein the second block and the third block both define internal volumes;

a first base member configured to be retained in the internal volume of the second block when the transformable game toy is in a stowed state;

a second base member configured to be retained in the internal volume of the third block when the transformable game toy is in the stowed state; and a plurality of hinges including a first hinge attached to the first block and the second block, a second hinge attached to the second block and the third block, a third hinge attached to the third block and the fourth block, a first base member hinge attached to the second block and the first base member, and a second base member hinge attached to the third block and the second base member;

wherein the transformable game toy is configured to be adjustable from a stowed state to a fully deployed state by moving the first base member, the second base member, and the plurality of blocks using the plurality of hinges.

2. The transformable game toy of claim 1, wherein the plurality of blocks collectively forms a cube shape in the stowed state.

3. The transformable game toy of claim 1, wherein a geometry of the first block mirrors a geometry of the fourth block.

4. The transformable game toy of claim 3, wherein a geometry of the second block mirrors a geometry of the third block.

5. The transformable game toy of claim 1, wherein the transformable game toy is configured to be moved from the stowed state to a relatively horizontal state by rotating the second block relative to the third block using the second hinge.

6. The transformable game toy of claim 5, wherein the transformable game toy is configured to be moved from the relatively horizontal state to an intermediate state by rotating the first block relative to the second block using the first hinge and by rotating the fourth block relative to the third block using the third hinge.

7. The transformable game toy of claim 6, wherein the first base member is configured to move from a stowed position where the first base member is retained in the internal volume of the second block to an extended position where the first base member is rotated out of the internal volume of the second block, and wherein the second base member is configured to move from a stowed position where the second base member is retained in the internal volume of the third block to an extended position where the second base member is rotated out of the internal volume of the third block.

8. The transformable game toy of claim 1, further comprising a plurality of magnets.

9. The transformable game toy of claim 8, wherein a first magnet of the plurality of magnets is positioned in the first block, wherein a second magnet of the plurality of magnets is positioned in the fourth block, and wherein the first magnet and the second magnet are configured to be attracted together to assist in retaining the first block and the fourth block in contact with each other.

10. The transformable game toy of claim 1, wherein the first base member is configured to move from a stowed position where the first base member is retained in the internal volume of the second block to an extended position where the first base member is rotated out of the internal volume of the second block, and wherein the second base member is configured to move from a stowed position where the second base member is retained in the internal volume of the third block to an extended position where the second base member is rotated out of the internal volume of the third block.

11. The transformable game toy of claim 10, further comprising:

a first magnet positioned at the first base member; and a second magnet positioned at the second base member, wherein the first magnet and the second magnet are configured to be attracted together to assist in retaining the first base member and the second base member in contact with each other when the transformable game toy is in the fully deployed state.

12. The transformable game toy of claim 1, further comprising:

a first protrusion; and a second protrusion, wherein the first block defines a first recess, wherein the fourth block defines a second recess, wherein the first block is configured to receive the first protrusion in the first recess when the transformable game toy is in the fully deployed state so that the first protrusion extends out relative to the first block, and wherein the fourth block is configured to receive the second protrusion in the second recess when the transformable game toy is in the fully deployed state so that the second protrusion extends out relative to the fourth block.

13. The transformable game toy of claim 12, wherein one portion of the first protrusion is received within the first recess when the transformable game toy is in the stowed state, wherein another portion of the first protrusion is received within the second recess when the transformable game toy is in the stowed state, wherein one portion of the second protrusion is received within the first recess when the transformable game toy is in the stowed state, and wherein another portion of the second protrusion is received within the second recess when the transformable game toy is in the stowed state.

14. The transformable game toy of claim 13, wherein the first protrusion is configured to be moved within the first recess.

15. A method for adjusting a transformable game toy, the method comprising:

providing a transformable game toy, the transformable game toy comprising:

a plurality of blocks that are configured to be moved relative to each other to change the appearance of the transformable game toy, wherein the plurality of blocks includes a first block, a second block, a third block, and a fourth block, wherein the second block and the third block both define internal volumes;

a first base member, wherein the first base member is configured to be retained in the internal volume of the second block when the transformable game toy is in a stowed state;

a second base member, wherein the second base member is configured to be retained in the internal volume of the third block when the transformable game toy is in a stowed state; and a plurality of hinges, including a first hinge connecting the first block and the second block, a second hinge connecting the second block and the third block, a third hinge connecting the third block and the fourth block, a first base member hinge connecting the second block and the first base member, and a second base member hinge connecting the third block and the second base member;

moving the transformable game toy from the stowed state to a relatively horizontal state by rotating the second block relative to the third block using the second hinge;

moving the transformable game toy from the relatively horizontal state to an intermediate state by rotating the first block relative to the second block using the first hinge and by rotating the fourth block relative to the third block using the third hinge; and moving the transformable game toy from the intermediate state to the fully deployed state by rotating the first base member relative to the second block using the first base member hinge and by rotating the second base member relative to the third block using the second base member hinge, wherein the first base member is not retained in the internal volume of the second block when the transformable game toy is in the fully deployed state, and wherein the second base member is not retained in the internal volume of the third block when the transformable game toy is in the fully deployed state.

16. The method of claim 15, further comprising:

moving the transformable game toy from the fully deployed state to the intermediate state by rotating the first base member relative to the second block using the first base member hinge so that the first base member is retained in the internal volume of the second block and by rotating the second base member relative to the third block using the second base member hinge so that the second base member is retained in the internal volume of the third block;

moving the transformable game toy from the intermediate state to the relatively horizontal state by rotating the first block relative to the second block using the first hinge and by rotating the fourth block relative to the third block using the third hinge; and moving the transformable game toy from the relatively horizontal state to the stowed state by rotating the second block relative to the third block using the second hinge.

* * * * *